US007101462B2

(12) United States Patent
Bricco et al.

(10) Patent No.: US 7,101,462 B2
(45) Date of Patent: Sep. 5, 2006

(54) METHOD AND APPARATUS FOR FORMING A PAPER OR TISSUE WEB

(75) Inventors: Michael J. Bricco, Larsen, WI (US); Dale J. Reynebeau, Little Chute, WI (US)

(73) Assignee: Vibre-Tech, LLC, Little Chute, WI (US)

( * ) Notice: Subject to any disclaimer, the term of this patent is extended or adjusted under 35 U.S.C. 154(b) by 0 days.

(21) Appl. No.: 10/646,367

(22) Filed: Aug. 22, 2003

(65) Prior Publication Data

US 2004/0140077 A1 Jul. 22, 2004

Related U.S. Application Data

(63) Continuation-in-part of application No. 10/027,507, filed on Dec. 21, 2001, now Pat. No. 6,702,925.

(51) Int. Cl.
*D21F 1/20* (2006.01)
*D21F 1/18* (2006.01)

(52) U.S. Cl. ..... 162/355; 162/351; 162/354

(58) Field of Classification Search ..... 162/308–310, 162/312–314, 289, 351–356, 348, 208–211, 162/363–366, 374; 209/920; 366/127; 134/1
See application file for complete search history.

(56) References Cited

U.S. PATENT DOCUMENTS

| | | | | |
|---|---|---|---|---|
| 568,211 | A | 9/1896 | Savery | |
| 695,753 | A | 3/1902 | Moore et al. | |
| 1,623,157 | A | 4/1927 | Berry | |
| 1,670,884 | A | 5/1928 | Erkens | |
| 1,839,158 | A | 12/1931 | McDonnell | |
| 1,841,702 | A * | 1/1932 | Berry | 162/356 |
| 2,076,991 | A | 4/1937 | Holgersson et al. | |
| 2,092,798 | A | 9/1937 | Charlton | |
| 2,095,378 | A | 10/1937 | Charlton | |
| 2,124,028 | A * | 7/1938 | Charlton | 162/356 |
| 2,128,269 | A | 8/1938 | Smith | |
| 2,727,442 | A | 12/1955 | Hayes | |
| 2,999,265 | A | 9/1961 | Duane et al. | |
| 3,088,158 | A | 5/1963 | Boyle et al. | |
| 3,598,694 | A | 8/1971 | Wiebe | |
| 3,624,224 | A | 11/1971 | Watchung et al. | |
| 3,795,571 | A | 3/1974 | Prentice | |
| 3,810,817 | A | 5/1974 | Arledter | |
| 3,827,857 | A | 8/1974 | Boulus | |
| 3,864,207 | A * | 2/1975 | Ekberg | 162/365 |
| 3,870,282 | A | 3/1975 | Wadensten | |

(Continued)

FOREIGN PATENT DOCUMENTS

| | | |
|---|---|---|
| WO | WO97/30213 | 8/1997 |

OTHER PUBLICATIONS

"Forming Section Maintenance"; Beloit Corporation (1 page).

(Continued)

*Primary Examiner*—Eric Hug
(74) *Attorney, Agent, or Firm*—Michael Best & Friedrich

(57) ABSTRACT

A method and apparatus for transferring a vibrational force to the wire of a papermaking machine in order to re-align the fibers of the web forming on the wire or to clean press section felts. In some embodiments, the apparatus is a vibrational device including at least one vibration-inducing mechanism, a vibrational head coupled to the vibration-inducing mechanism for vibrating the wire, and a dampening mechanism coupled between the vibrational head and the vibration-inducing mechanism.

39 Claims, 21 Drawing Sheets

U.S. PATENT DOCUMENTS

| | | | |
|---|---|---|---|
| 3,925,150 | A | 12/1975 | Marsh |
| 3,932,057 | A | 1/1976 | Wadensten |
| 3,938,905 | A | 2/1976 | Wadensten |
| 3,978,185 | A | 8/1976 | Buntin et al. |
| 4,055,460 | A | 10/1977 | Buchanan |
| 4,306,934 | A | 12/1981 | Seppanen |
| 4,389,120 | A | 6/1983 | Wadensten |
| 4,391,672 | A | 7/1983 | Lehtinen |
| 4,424,718 | A | 1/1984 | Wadensten |
| 4,562,969 | A | 1/1986 | Lindahl |
| 4,648,943 | A | 3/1987 | Malashenko et al. |
| 4,838,996 | A | 6/1989 | Kallmes |
| 4,983,258 | A | 1/1991 | Maxham |
| 5,002,633 | A | 3/1991 | Maxham |
| 5,080,760 | A | 1/1992 | Smith et al. |
| 5,089,090 | A | 2/1992 | Hansen |
| 5,137,599 | A | 8/1992 | Maxham |
| 5,306,394 | A | 4/1994 | Meinander |
| 5,360,519 | A | 11/1994 | Scarano |
| 5,423,993 | A | 6/1995 | Boney, Jr. |
| 5,453,193 | A | 9/1995 | Maher et al. |
| 5,578,170 | A | 11/1996 | Erikson |
| 5,681,430 | A | 10/1997 | Neun et al. |
| 5,704,268 | A | 1/1998 | Hinchcliff |
| 5,802,648 | A | 9/1998 | Neun et al. |
| 5,807,465 | A | 9/1998 | Knapick et al. |
| 5,830,322 | A | 11/1998 | Cabrera y Lopez Caram et al. |
| 5,882,480 | A | 3/1999 | Knapick et al. |
| 5,888,345 | A | 3/1999 | Knapick et al. |
| 5,922,173 | A | 7/1999 | Neun et al. |
| 5,932,072 | A | 8/1999 | Neun et al. |
| 5,951,822 | A | 9/1999 | Knapick et al. |
| 5,951,823 | A | 9/1999 | Cabrera Y Lopez Caram et al. |
| 6,019,873 | A | 2/2000 | Knapick et al. |
| 6,030,501 | A | 2/2000 | Neun et al. |
| 6,702,925 | B1 | 3/2004 | Bricco et al. |

OTHER PUBLICATIONS

Calkin, Modern Pulp and Paper Making, 3rd Ed., (1957), Reinhold Publishing Corp., p. 312-313.

US 6,134,809, 10/2000, Stipp (withdrawn)

* cited by examiner

METHOD AND APPARATUS FOR FORMING A PAPER OR TISSUE WEB

CROSS-REFERENCE TO RELATED APPLICATION

This is a continuation-in-part of U.S. patent application Ser. No. 10/027,507, now U.S. Pat. No. 6,702,925, filed on Dec. 21, 2001, the entire disclosure of which is incorporated herein by reference.

FIELD OF THE INVENTION

This invention relates generally to forming a paper or tissue web, and more particularly to apparatuses and methods for improving the fiber distribution within a paper or tissue web.

BACKGROUND OF THE INVENTION

Paper and tissue are typically manufactured in a continuous sheet on a papermaking machine. One of the most common papermaking machines is the Fourdrinier machine. Fourdrinier machines generally include at least three sections: a wet-end section, a press section, and a dryer section. The wet-end section, which can be 40 to 100 feet in length, is also referred to as the forming section or the Fourdrinier table. In the wet-end section, stock flow is transferred from a headbox onto a moving, endless belt of wire-mesh screen, referred to as the Fourdrinier wire, or simply as the "wire." Stock flow is normally a combination of wood fibers, fines and fillers, chemical additives such as bonding agents, and water. Wood fibers typically range in length from 400 to 7,000 microns and in width from 20 to 100 microns, depending on the species of the wood. Stock flow typically has a liquid consistency of 99 percent and a fiber consistency of approximately 0.2 to 1 percent (although other fiber consistencies are possible), depending on the grade and weight of the paper or tissue being manufactured.

The function of the headbox is to distribute stock flow with a uniform fiber distribution to the wire in order to produce a sheet of paper having uniform properties across the width of the wire (cross-machine direction), along the length of the wire (machine direction), and through the cross-section of the sheet of paper (Z direction). The headbox distributes stock flow to the wire at an angle other than absolute tangent, referred to as the angle of impingement. If the angle of impingement is steep, i.e., close to absolute tangent, the arrangement of the headbox is referred to as pressure forming. If the angle of impingement is shallow, i.e., not close to absolute tangent, the arrangement of the headbox is referred to as velocity forming.

The wire runs over a breast roll, which is usually located under the headbox. The wire is typically not a permanent part of the papermaking machine and requires periodic replacement. One condition leading to premature failure of the wire is the plugging of the openings in the porous wire by the fibers, fines, and fillers of the web being transported by the wire. Normally, the wire is a delicate, finely woven metal or synthetic fiber cloth that allows for drainage of the water, but retains most of the fibers. The strands of the wire are commonly made of finely drawn and woven, annealed bronze or brass.

After the stock flow is delivered from the headbox to the wire in the wet-end section of a Fourdrinier machine, the fibers are initially held in free suspension within the water as relatively mobile individual fibers or as part of a network, referred to as a floc. The fibers and flocs in the stock flow begin to form a wet sheet of matted pulp, referred to as an embryonic web. While not subscribing to any particular manner in which the embryonic web is formed, normally either bonding agents in the stock flow cause an electrochemical bond or the bond is produced through physical entanglement. The embryonic web forms as the fibers and flocs in free suspension begin to settle in layers on the wire. Ideally, the fiber distribution within the web would be consistent in the cross-machine direction, the machine direction, and the Z direction. However, due to gravitational forces, the bottom-most layers of fibers that settle directly on the wire are typically more dense than the upper-most layers of fibers. The web normally has boundary layers (i.e., the two external layers of the web, such as the bottom-most layer of fibers that settles directly on the wire and the upper-most layer of fibers) and internal web fibers (fibers in the layers of the web between the two external layers of fibers). The web may consist of approximately 2 to 100 layers of fibers.

In order to assist in the formation of the embryonic web, as the wire moves away from the headbox, various suction devices can be used to drain water from the stock flow. The suction devices in the Fourdrinier machine typically include a series of stationary blades or foils. The stationary foils remove water from the stock flow by creating a vacuum on the downstream side of the blade where the wire leaves the blade surface. As the wire moves across a series of stationary foils, the downstream side of each stationary foil creates a vacuum that pulls water from the stock flow, while the upstream side of each stationary foil pulls the water off of the wire. Some of the wood fibers, fines, and fillers are pulled off of the wire along with the water being pulled off of the wire. The amount of fibers, fines, and fillers that are retained on the wire while the water is being pulled off of the wire is referred to as retention.

Once the wire passes over the stationary foils, the wire normally passes over a drive roll or couch roll, over a series of return rolls, and back to the breast roll. At the end of the wet-end section of the Fourdrinier machine, the web can have a water consistency of approximately 80 percent and a fiber consistency of approximately 20 percent. At this point, the web can normally support its own weight. Other water and fiber consistencies are also possible at this point for enabling the web to support its own weight.

Next, the web can be transferred from the wet-end section of the Fourdrinier machine to the press section at the couch roll. The wet web of paper is normally transferred from the wire of the wet-end section to a screen. The screen can be a woolen felt screen, referred to as a felt, acting as a conveyor belt to carry the web through the press section. The felt is typically porous media that provides space and channels for water removal. The felt can also act as a textured cushion or shock absorber for pressing the moist web without crushing the web. The texture and character of the felt varies according to the grade of the paper being made. The felt normally carries the web through two or more press rolls, which mechanically squeeze water from the web. A variety of suction devices, one of which is commonly referred to as a uhle box, can also be used to remove water from the felt. The press rolls often consist of a steel or cast iron core covered by a bronze or stainless steel inner shell and an outer rubber shell. At the end of the press section of the Fourdrinier machine, the web typically has a consistency of approximately 40 percent water and 60 percent fiber, although other web consistencies at this stage are possible.

After the press section, the web can be transferred to fabric dryer felts that carry the web through the dryer section. The dryer felts are most commonly constructed of a highly permeable cotton blend or open-mesh fabric. The web is normally held firmly against a number of steam-heated cylinders or drums by the dryer felts in order to evaporate the remaining water. As the web passes from one cylinder to another, first the felt side and then the web side are pressed against the heated surfaces of the cylinders. In addition, hot air may be blown onto the web and between the cylinders to vaporize water from the web. At the end of the dryer section, the completed web typically has a consistency of approximately 1 to 10 percent water and approximately 90 to 99 percent fiber, although other web consistencies are possible at this stage.

The quality of the paper web produced in the papermaking process depends in part on the orientation of the fibers and the consistency of fiber distribution when the embryonic web is formed in the wet-end section of the Fourdrinier machine. The orientation of the fibers within the embryonic web first depends on the distribution of the stock flow to the wire by the headbox. In a pressure forming arrangement of the headbox, the web's boundary layer fibers often become impregnated in the wire. When the web is later transferred from the wire, the boundary layer fibers impregnated in the wire are pulled from the web, leaving small holes in the web. These small holes in the web result in a web that is not as smooth on one side as it is on the other (often called the "phenomena of two-sidedness"). Also, in a pressure forming arrangement, the web's internal layer fibers become forcibly and sporadically misaligned. In a velocity forming arrangement of the headbox, the sheet is formed through a thickening mechanism. This thickening mechanism is due in part to gravitational forces pulling the fibers and the water down through the wire, which causes the bottom-most layers of fibers that settle directly on the wire to be more dense than the upper-most layers of fibers. This high-density layer prevents fibers, fines, and fillers from being pulled through the wire (i.e., higher retention). This high-density layer also prevents water from draining through the wire, resulting in two-sidedness. Both the phenomena of two-sidedness and the disparate orientation of internal layer fibers reduce the quality of the finished paper web.

As water is mechanically squeezed from the paper web in the press section, fines, fillers, and fibers become impregnated in the felt carrying the paper web. The fines, fillers, and fibers plug the felt's water removal channels, resulting in the felt becoming less efficient in removing water from the paper web. As the felt in the press section becomes less efficient in removing water from the web, the dryer section must carry the burden of removing more water from the paper web.

A long-standing problem with papermaking machinery and processes is the large amount of energy required to run the machinery and to produce paper in such processes. A significant portion of this energy is consumed within the dryer section of the papermaking machine. Paper webs having poor fiber formation require significantly more heat to dry than paper webs with good fiber formation and distribution. Therefore, the problems described above regarding fiber misalignment and poor fiber distribution result in paper that requires more energy to dry and that is more costly to produce.

In addition, paper having poor fiber formation is typically lower in machine direction tensile strength when compared with the same grade of paper with a more consistent fiber distribution. This may require expensive chemical additives to increase web strength and can require more sizing, coating, calendaring, and converting operations to produce an acceptable paper product. Improving fiber formation by using more highly refined stock fibers can help to address these issues, but at a significantly increased pulp cost.

In light of the problems and limitations described above, a need exists for a method and apparatus for increasing the quality and manufacturing efficiency of a finished paper web by reducing the phenomena of two-sidedness, improving the distribution of internal layer fibers in the web, lowering the cost of web production through reduced energy requirements, reducing the amount of chemical additives needed for acceptable web strengths, enabling the use of less refined or lower quality stock, improving the retention of fines and fillers within the web, and keeping the forming and press fabrics clean. Each embodiment of the present invention achieves one or more of these results.

SUMMARY OF THE INVENTION

Preferred embodiments of the present invention provide a papermaking method and apparatus to improve the quality of a paper web by reducing the phenomena of two-sidedness, by improving the alignment and distribution of the fibers in the web, and by reducing the energy requirements of the papermaking process by increasing water removal from the web in the wet-end and press sections of the paper making machine. As used herein and in the appended claims, reference to a paper web is intended to refer to any type of paper or tissue web produced with a papermaking machine.

In some embodiments of the present invention, stock flow, including fibers and water, is discharged from a headbox onto a wire. A vibrational force is transferred to the wire in order to re-align the fibers. In addition, the water from the stock flow is drained to cause the fibers to form a web. The energy imparted to the wire by the vibrational force preferably causes the boundary layer fibers impregnated in the wire to be released from the wire. The energy imparted to the wire by the vibrational force also preferably causes release of internal layer fibers that have begun to form the embryonic web. The internal layer fibers can then re-align and re-settle on the traveling wire in a more natural and uniform pattern. As the internal layer fibers re-settle, the fibers can penetrate into empty voids within the web. Preferably, the vibrational force is transferred to the wire of the papermaking machine before significant water removal takes place, i.e. during the formation of the embryonic web. In some highly preferred embodiments of the present invention, the vibrational force is transferred to the underside of a substantially horizontal wire, such as the wire of a Fourdrinier papermaking machine. In these and other embodiments, a vibrational force is transferred to the forming or press fabrics of the papermaking machine in order to release the fibers, fines, and fillers that have become impregnated in the forming or press fabrics. In such embodiments, the vibrational force can be used in conjunction with conventional suction devices, if desired, in order to maintain the cleanliness and water removal efficiency of the fabrics.

Some preferred embodiments of the present invention employ a papermaking machine vibrational device having a vibrational device frame, at least one vibration-inducing mechanism coupled to the vibrational device frame, and a vibrational head coupled to the vibration-inducing mechanism. Any number of such vibrational devices can be located adjacent to the web-forming wire, adjacent to the press felt, or adjacent to both the web-forming wire and the press felts for imparting vibration to the wire or press felt as described above. The vibrational head of the vibrational device preferably engages the wire or press felt of the papermaking machine to impart a vibrational force to the wire or press felt. In some embodiments, the vibrational device is positioned under the wire or press felt in an orientation perpendicular to the direction of travel of the wire or press felt. The vibrational device can span the entire width or substantially the entire width of the wire or press felt in order to impart the vibrational force to the entire width of the web.

In some embodiments of the present invention, the vibrational device frame is mounted to the papermaking machine frame. The vibrational device frame can have a truss network mountable to the papermaking machine frame and supporting the vibration-inducing mechanisms and the vibrational head under the wire or press felt. In some preferred embodiments, the vibrational device includes a vertical adjustment mechanism coupled to the truss network to allow for vertical adjustment of the vibrational device with respect to the wire or press felt.

The vibration-inducing mechanisms are preferably pneumatic, hydraulic, or electric mechanisms that transfer a vibrational force to the vibrational head and wire or press felt. Although any type of vibration can be transferred to the head (and wire or press felt) in this manner, the vibration is preferably high frequency and low amplitude. Preferably, the frequency and amplitude of the force transferred by the vibration-inducing mechanisms can be varied through the use of a solenoid valve or an amplifier, if desired. In some embodiments, the frequency and amplitude of the force transferred by each vibration-inducing mechanism can be varied independently, in order to impart different forces to different portions of the web. For example, the frequency and amplitude of the forces transferred by two or more vibrational devices spaced in the cross-machine direction can vary to generate different vibration frequencies and amplitudes across the wire or press felt in the cross-machine direction. Preferably, a sliding mechanism is used to couple the vibration-inducing mechanisms to the vibrational head, thereby enabling quick and easy vibrational head replacement (even during operation of the papermaking machine in some embodiments).

The vibrational head preferably includes a land area through which the vibrational force is transferred from the vibrational head to the wire or press felt. In some embodiments of the present invention, the land area includes an upstream portion which slopes vertically downward from the wire or press felt at a lead angle, so that the lead angle pushes water up into the wire or press felt when the vibrational head engages the underside of the wire or press felt. The land area can also include a downstream portion which slopes vertically downward from the wire or press felt at a relief angle, so that the relief angle induces a vacuum when the vibrational head engages the underside of the wire or press felt. In other embodiments of the present invention, the land area has a concave configuration.

In some highly preferred embodiments of the present invention, a lubrication shower is positioned within the wet-end section or within the press section of the Fourdrinier machine upstream from the vibrational device in order to lubricate the wire or press felt, in order to re-fluidize the fibers within the web before the fibers reach the vibrational device, and in order to minimize air entrapment in the nip (i.e., vacuum) formed between the traveling wire or press felt and the vibrating head.

The vibrational device according to some embodiments can include one or more dampening mechanisms coupled between, adjacent to, or in any suitable position with respect to the vibration-inducing mechanisms and the vibrational head. In some embodiments, the vibrational device can include two or more vibration-inducing mechanisms and a vibrational head including a single vibrational element and two or more support members. A vibration-inducing mechanism can be coupled to each one of the support members. In addition, a dampening mechanism can be coupled between the two or more support members and the single vibrational element.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
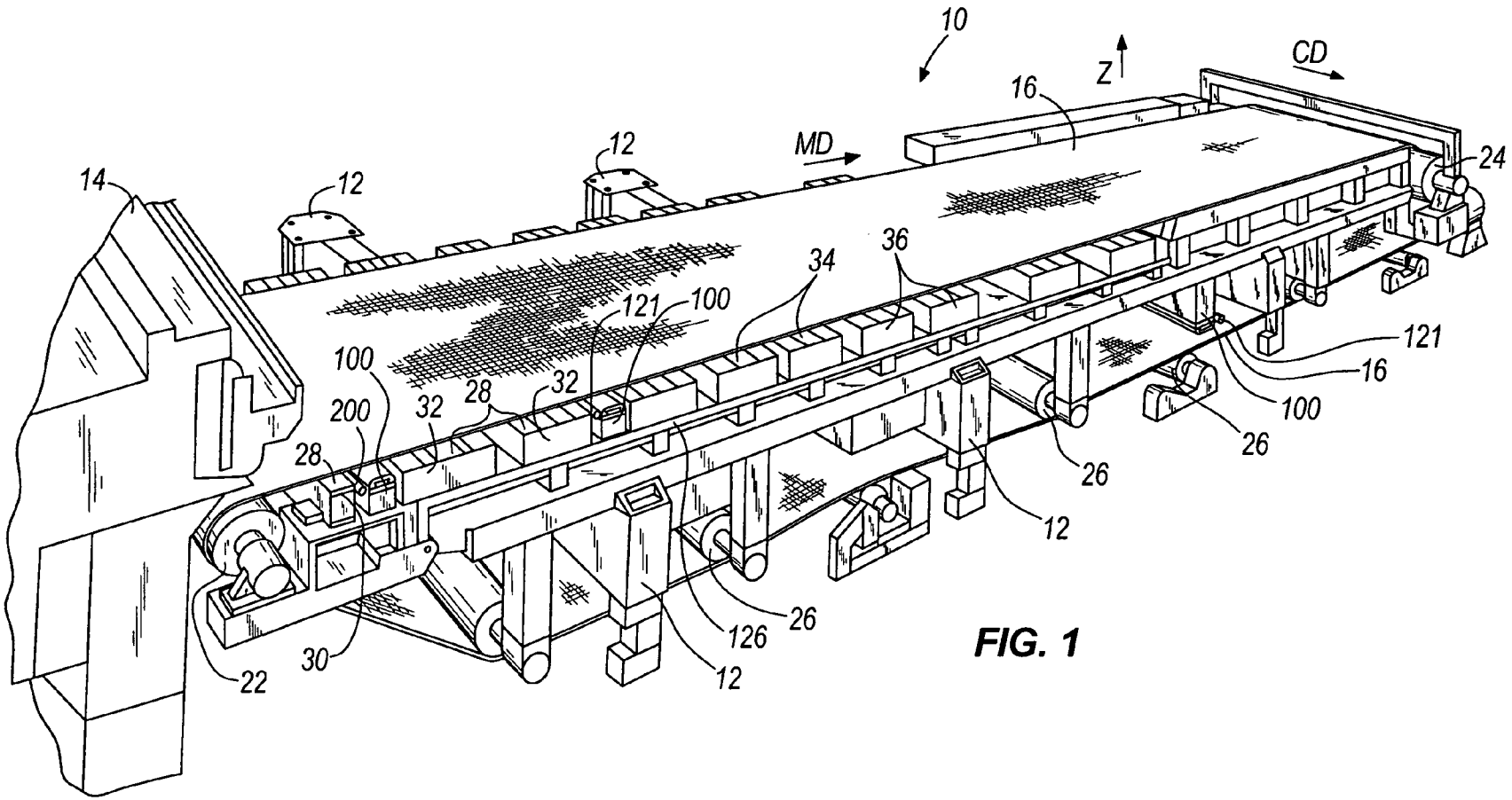
FIG. 1 is a perspective view of a papermaking machine wet-end section having vibrational devices according to a preferred embodiment of the present invention.
Figure 2:
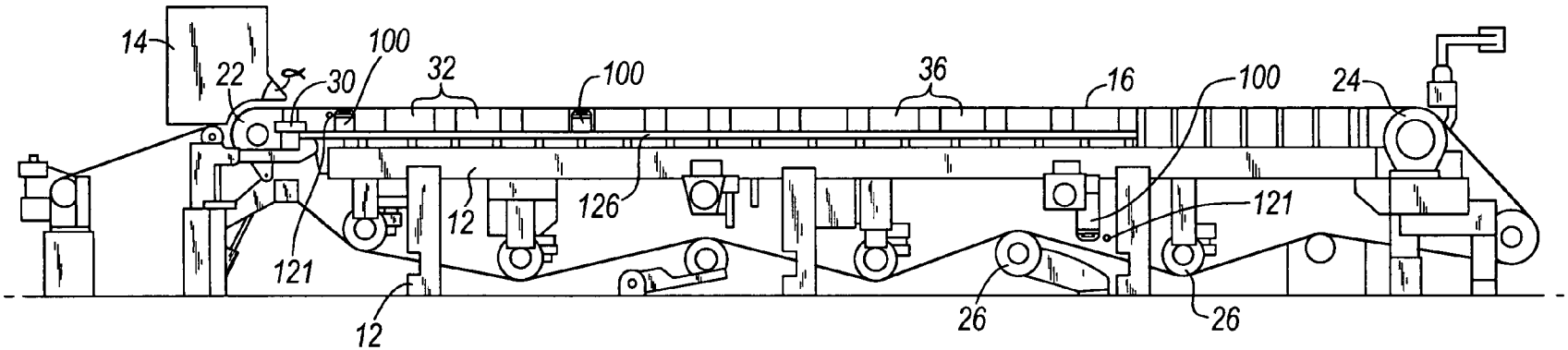
FIG. 2 is side elevational view of the papermaking machine shown in FIG. 1.

With reference to FIGS. 1 and 2, a preferred embodiment of the present invention employs a papermaking machine wet-end section 10 and a vibrational device 100. The papermaking machine wet-end section 10 can precede the press and dryer sections in a conventional papermaking machine. The papermaking machine wet-end section 10 as shown in FIG. 1 is also referred to as the forming section or the Fourdrinier table of the papermaking machine. The papermaking machine wet-end section 10 preferably includes a papermaking machine frame 12, a headbox 14, a wire 16, a breast roll 22, a couch roll 24, a plurality of return rolls 26, and a plurality of suction devices 28.

Figure 4:
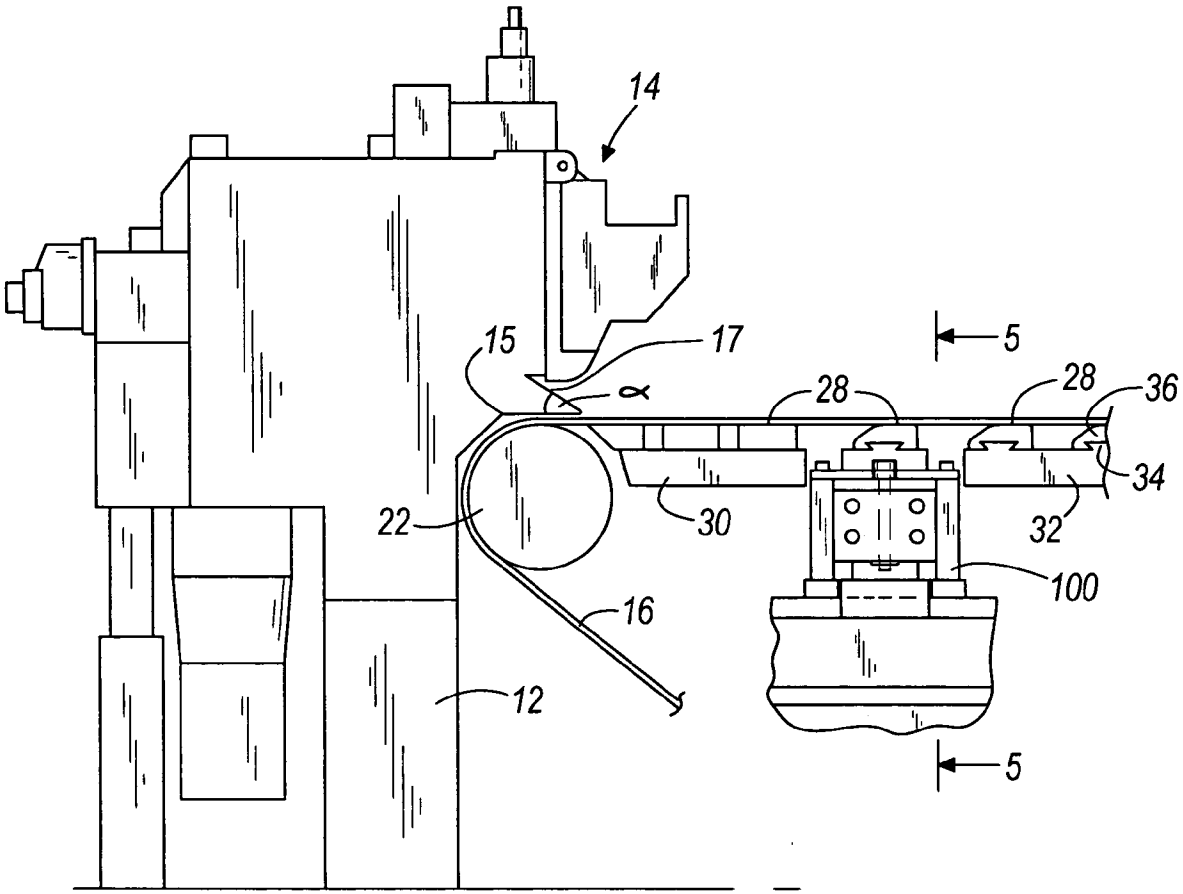
FIG. 4 is a detail view of the papermaking machine shown in FIG. 1.

The headbox 14 is positioned adjacent to the papermaking machine frame 12 in order to distribute stock flow onto the wire 16. Any conventional headbox in the papermaking art can be employed in order to distribute stock flow onto the wire 16. The headbox 14 preferably distributes stock flow to the wire 16 in order to produce a web having uniform properties across the width of the wire 16, referred to as the cross-machine direction (CD), along the length of the wire 16, referred to as the machine direction (MD), and through the cross-section of the web, referred to as the Z direction (Z), as shown in FIG. 1. As best shown in FIG. 4, the headbox 14 preferably distributes stock flow to the wire 16 at an angle of impingement $\alpha$, which is an angle other than absolute tangent to the wire 16. The angle of impingement $\alpha$ is the angle between two portions of the headbox 14, namely an apron lip 15 and a slice lip 17. If the angle of impingement $\alpha$ is steep, i.e., close to absolute tangent to the wire 16, the arrangement of the headbox is referred to as pressure forming. If the angle of impingement $\alpha$ is shallow, i.e., not close to absolute tangent, the arrangement of the headbox 14 is referred to as velocity forming.

The wire 16, which may also be referred to as the Fourdrinier wire, is preferably a moving, endless belt of wire-mesh screen. The wire 16 is movably coupled to the papermaking machine frame 12 via several rolls in a manner that provides an endless conveyor belt for receiving and transporting stock flow distributed by the headbox 14. The wire 16 first wraps around the breast roll 22, (which is preferably positioned adjacent to the headbox 14 and generally directly under the headbox 14), stretches from the breast roll 22 across the length of the wet-end section 10 to the couch roll 24, wraps around the couch roll 24, and stretches around the plurality of return rolls 26 to return to the breast roll 22. One having ordinary skill in the art will appreciate that the wire 16 can be driven about other elements in an endless-conveyor arrangement, such as by being passed around one or more sprockets, pulleys, or other preferably rotatable elements.

Figure 3:
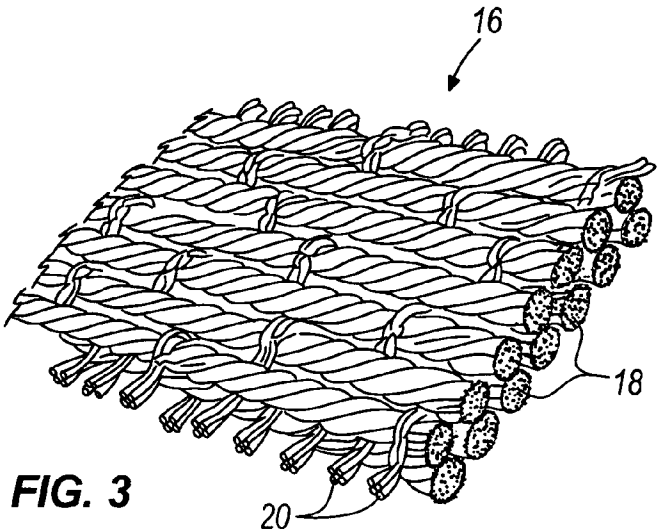
FIG. 3 is a perspective view of a wire portion of the papermaking machine shown in FIG. 1.

As shown in FIG. 3, the wire 16 is preferably a delicate, finely woven metal or synthetic fiber cloth that allows the drainage of water, but retains most of the fibers from the stock flow. Although finely woven metal or synthetic fiber wire is preferred, any other type of papermaking wire can be employed in connection with the present invention. In one highly preferred type of wire shown in FIG. 3, a plurality of main strands 18 and a plurality of connecting strands 20 are woven together to form the wire 16. The plurality of main strands 18 and the plurality of connecting strands 20 can be made of finely drawn and woven, annealed bronze or brass, or can be made of other conventional wire materials as desired. For example, the plurality of main strands 18 and the plurality of connecting strands 20 can instead be made of polyester monofilaments. The weave of the wire 16 can be varied in order to inhibit or aid drainage through the wire 16. One of ordinary skill in the art will appreciate that the weave pattern of the wire 16 can be of single, double, triple, or any other layer design and therefore needs no further description herein. The wire 16 is preferably not a permanent part of the papermaking machine wet-end section 10 and can be replaced in a conventional manner.

As shown in FIGS. 1 and 2, a plurality of devices 28 are preferably employed to control water within and exiting from the stock flow, leaving a wet sheet of matted pulp, i.e. the web, that travels on the wire 16. In the highly preferred embodiment shown in FIGS. 1 and 2, these devices 28 include an initial forming board 30, a plurality of foil boxes 32, and at least one vibrational device 100. The initial forming board 30 is preferably an elongated board having a flat topside positioned under the wire 16. Alternative types of initial forming boards can instead be used as desired. Preferably, the initial forming board 30 is positioned downstream from the headbox 14 so that it is the first of the devices 28 to engage the wire 16. In this position, the initial forming board 30 creates an initial dwell time during which a small amount of water is drained from the stock flow and the web is allowed to begin forming as the wire 16 travels over the initial forming board 30. The initial forming board 30, and forming boards in general, are well-known devices in the papermaking art and are not therefore described further herein.

The plurality of foil boxes 32 are preferably positioned under the wire 16, downstream from the initial forming board 30, and run in the cross-machine direction. Preferably, each one of the plurality of foil boxes 32 is coupled to the papermaking machine frame 12 and includes a plurality of T-bars 34 and a plurality of stationary (or adjustable) foils or blades 36 coupled to the plurality of T-bars 34. As is conventional in the papermaking industry, the stationary foils 36 are each preferably 2½ inches wide. However, the stationary foils 36 may be any width. The stationary foils 36 each preferably have a lead angle that strips water off of the wire and a surface downstream from the lead angle that creates a vacuum to pull water down from the wire 16. The surface downstream from the lead angle is preferably flat, but can be shaped in a number of different manners to generate vacuum downstream of the lead angle (including without surfaces that are wave-shaped, stepped, multi-faceted, curved convexly and/or concavely, and the like). The lead angle of each subsequent, downstream stationary foil 36 strips the water off of the wire 16 that was pulled down by the vacuum created by the preferably flat surface of the preceding, upstream stationary foil 36. In this manner, water is drained from the wire 16 in the wet-end section 10 and the web begins to form. The wet-end section 10 can include a large number (e.g., 100) of stationary foils 36 coupled to the plurality of foil boxes 32. It should be noted that stationary foils 36 need not necessarily be connected to or otherwise be used in conjunction with foil boxes 32, although foil boxes 32 are a preferred manner of collecting and transporting water from beneath the wire 16. In addition, although T-shaped bars 34 are a highly preferred manner of connecting the stationary foils 36 to associated framework of the papermaking machine, the stationary foils 36 can be connected in desired locations in any other conventional manner, such as by fastening the stationary foils 34 with one or more bolts, screws, clamps, rivets, pins, or other conventional fasteners, by snap-fitting the foils to connecting points on the papermaking machine, and the like. Stationary foils, their manner of operation and connection, and the various forms of stationary foils are also well-known suction devices in the papermaking art and are not therefore described further herein.

Figure 5A:
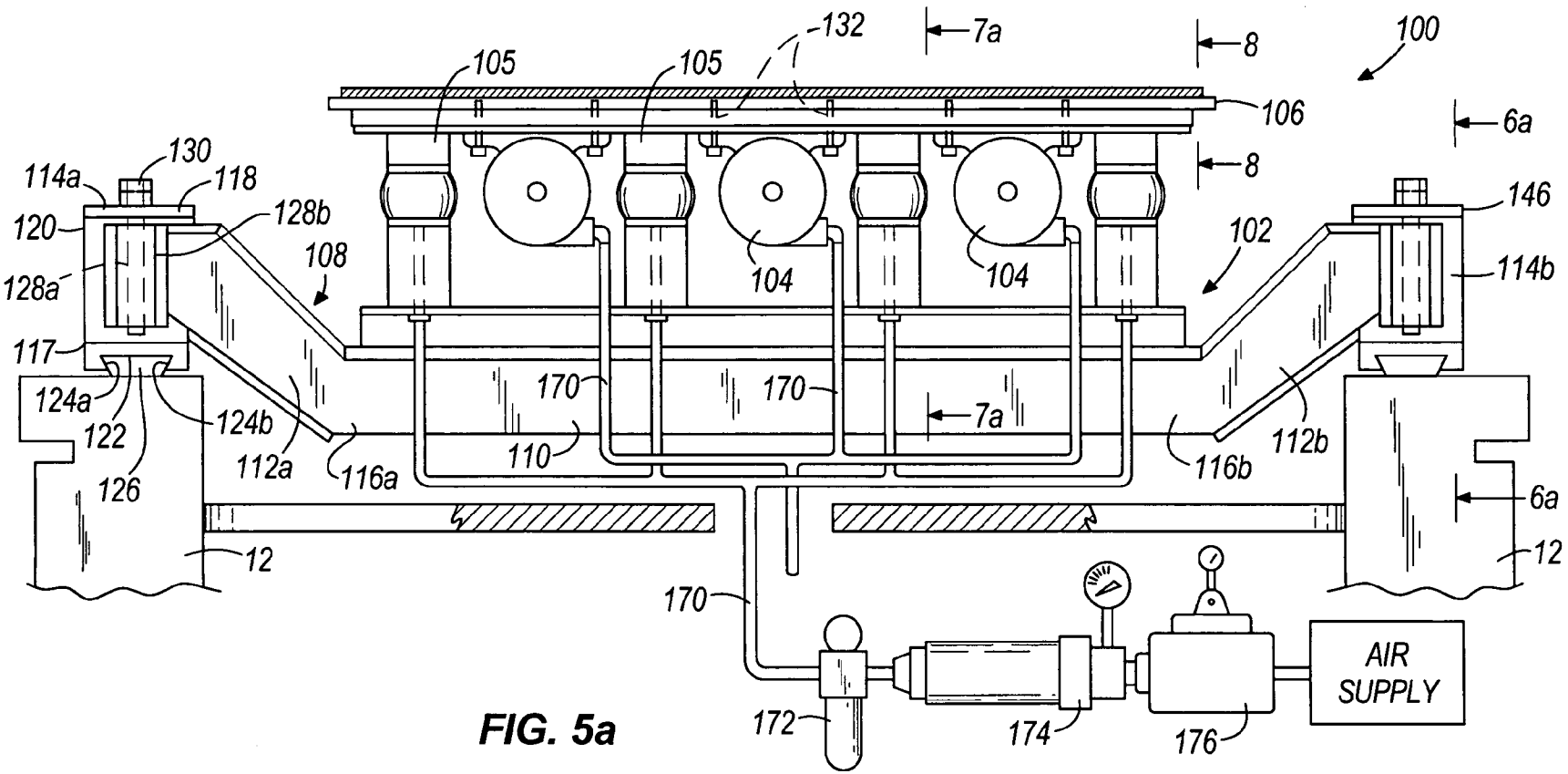
FIG. 5*a* is a front elevational view of a vibrational device used in the papermaking machine shown in FIG. 1, viewed from line 5—5 of FIG. 4.
Figure 5B:
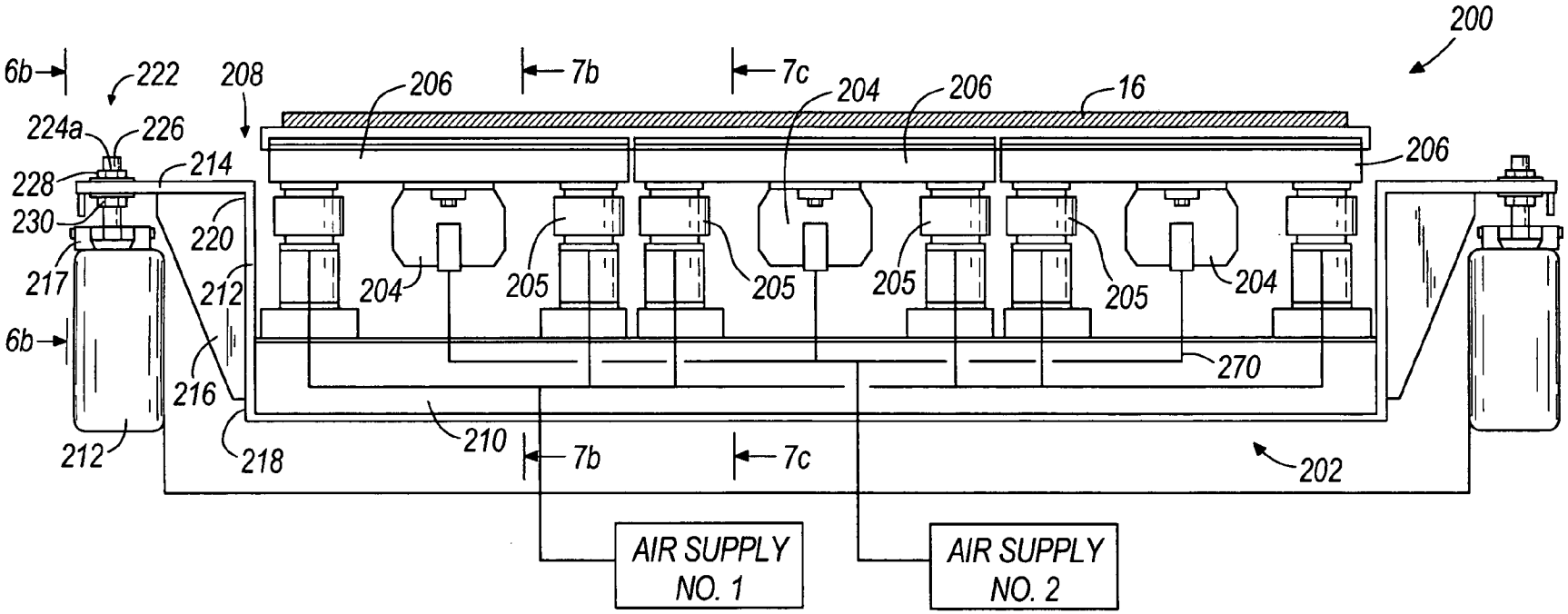
FIG. 5*b* is a front elevational view of an alternative vibrational device according to the present invention, viewed from line 5—5 of FIG. 4.

The papermaking machine wet-end section 10 preferably also includes at least one vibrational device 100. As shown in FIGS. 5*a* and 5*b*, the vibrational device 100 includes a vibrational device frame 102 mountable to the papermaking machine frame 12 (or to other positions inside or adjacent to the papermaking machine frame 12), one or more vibration-inducing mechanisms 104 coupled to the vibrational device frame 102, a vibrational head 106 coupled to the vibration-inducing mechanisms 104, and one or more vibration isolators 105 coupled between the vibrational head 106 and the vibrational device frame 102. The vibrational device frame 102 preferably includes a truss network 108 which provides a bridge between each side of the papermaking machine frame 12 for supporting the vibrational device 100 under the wire 16. The truss network 108 includes a horizontal truss 110, a pair of diagonal trusses 112*a* and 112*b* coupled to each end of the horizontal truss 110, and a pair of brackets 114*a* and 114*b* coupled to the ends of the diagonal trusses 112*a* and 112*b*. Preferably, the horizontal truss 110 is mounted under the wire 16 and runs in substantially the cross-machine direction. Preferably, the horizontal truss 110 spans the entire width of the wire 16.

The diagonal truss 112*a* is coupled between a first end 116*a* of the horizontal truss 110 and the bracket 114*a*. The diagonal truss 112*b* is coupled between a second end 116*b* of the horizontal truss 110 and the bracket 114*b*. Rather than using a single horizontal truss to support the vibrational device 100, the pair of diagonal trusses 112*a* and 112*b* are preferably used to position the horizontal truss 110 somewhat below the height of the papermaking machine frame 12. However, a single horizontal truss could be used to support the vibrational device 100.

Figure 5C:
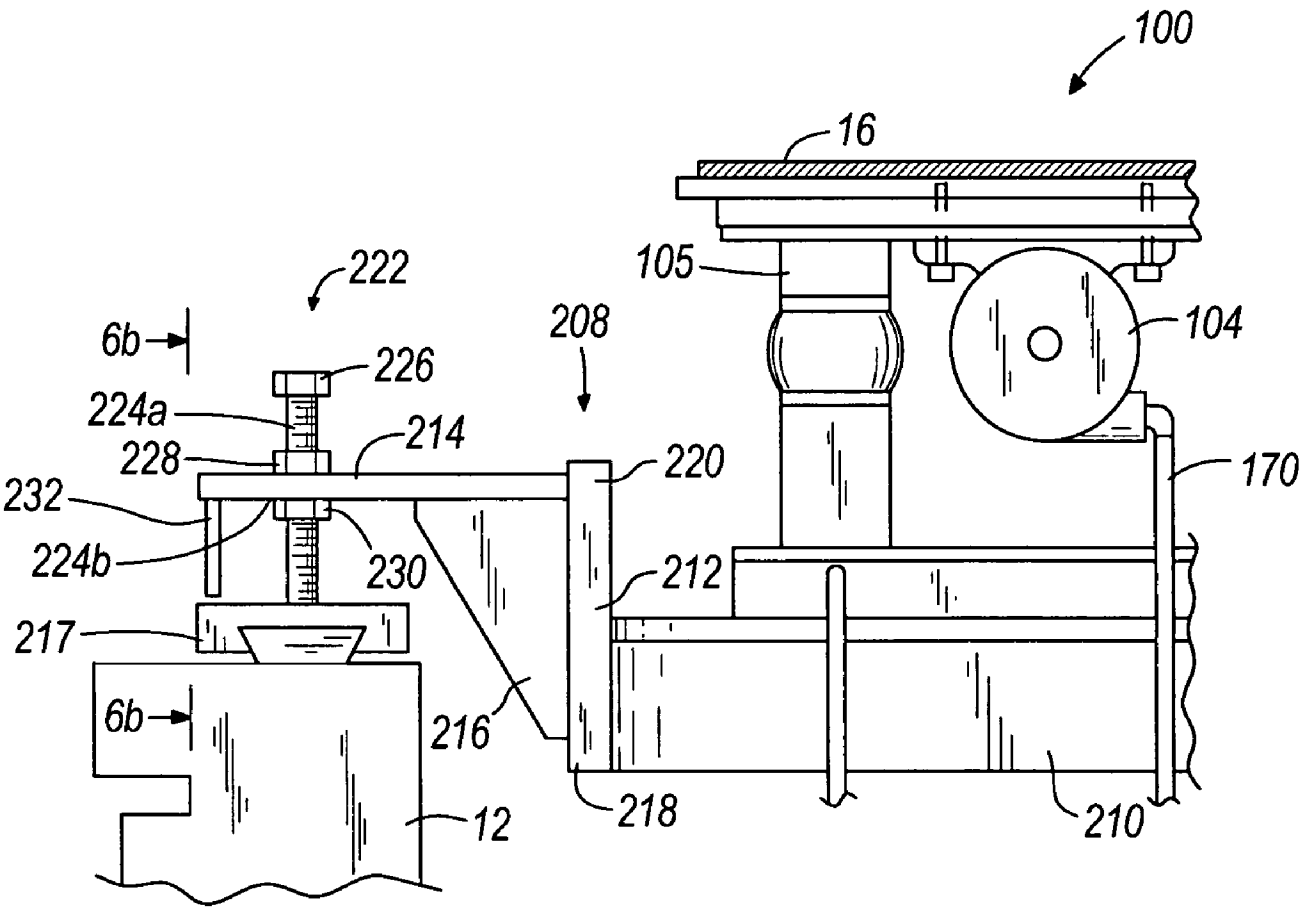
FIG. 5*c* is a detail view of the vibrational device shown in FIG. 5*a*, used with the truss of FIG. 5*b;*

In other preferred embodiments as shown in FIGS. 5*b* and 5*c*, a vibrational device 200 includes a truss network 208. The truss network 208 includes a first horizontal truss 210, a vertical truss 212, a second horizontal truss 214, and a diagonal support truss 216. The first horizontal truss 210 is coupled to a first end 218 of the vertical truss 212, and the second horizontal truss 214 is coupled to a second end 220 of the vertical truss 212. The diagonal support truss 216 is coupled between the second horizontal truss 214 and the vertical truss 212. The embodiment of the present invention in FIG. 5*c* is an example of how the trusses, truss ends, and vertical adjustment mechanisms (described in greater detail below) of the various embodiments of the present invention can be interchanged as desired.

Still other truss network shapes and designs are possible for serving the purpose of supporting the vibrational devices 100, 200 adjacent to the wire 16, each one of which falls within the spirit and scope of the present invention. Specifically, any truss element or structure having any shape and being made from any number of elements (including without limitation plates, beams, rods, bars, and the like) connected together in any conventional manner could be used to support the vibrational device 100, 200 from beneath as shown in the figures or from any other location on the vibrational device 100, 200. The resulting truss element or structure can have any shape desired, and can be connected to the papermaking machine frame in any conventional manner (i.e., with or without brackets). Most preferably however, the truss element or structure provides substantially no vertical deflection in the center of the cross-machine direction of the wire 16. Put differently, the truss network preferably provides a mounting base for the vibrational device 100, 200 that runs in the cross-machine direction and is completely stationary with respect to the vertical orientation of the wire 16.

Although the vibrational device 100, 200 is preferably connected to and supported by the horizontal truss 110, 210 as described above, it should be noted that in some alternative embodiments the vibrational device 100, 200 is connected directly to a member of the papermaking machine frame (e.g., a beam, plate, stretcher, or other element running partially or fully across the papermaking machine in the cross-machine direction). This papermaking machine frame member can be rigidly and permanently attached to the remainder of the papermaking machine or can be adjustable as described in more detail below with regard to the horizontal truss 110, 210 in the illustrated preferred embodiments.

Figure 6A:
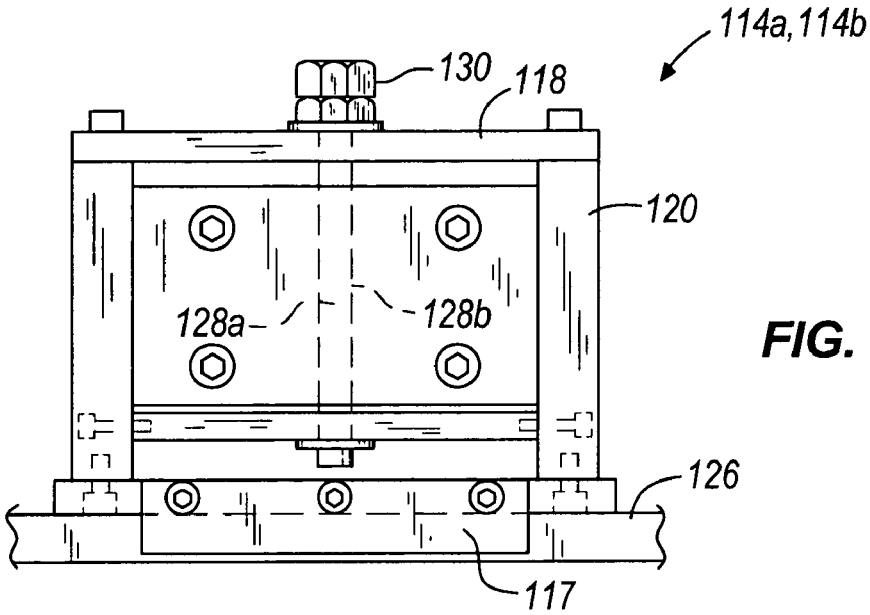
FIG. 6*a* is a side elevational view of the vertical adjustment mechanism of the vibrational device illustrated in FIG. 5*a*, viewed from line 6*a*—6*a* of FIG. 5*a;*

With particular reference to FIG. 6*a*, each bracket 114*a*, 114*b* in the illustrated preferred embodiment of FIGS. 4 and 5*a* preferably has a bottom plate 117 and a top plate 118 coupled between a vertical adjustment mechanism 120. As shown in FIG. 5*a*, the bottom plate 117 preferably includes a horizontal engagement surface 122 and a pair of diagonal engagement surfaces 124*a* and 124*b*. The diagonal engagement surfaces 124*a* and 124*b* are preferably configured to form a narrow bottom opening that slopes to meet the horizontal engagement surface 122 to form a broader top opening, i.e., a female dovetail configuration. The female dovetail configuration of the bottom plate 116 is connectable to a dovetail support member 126 having a male dovetail configuration coupled to the papermaking machine frame 12. As best shown in FIG. 1, the dovetail support member 126 extends along at least a portion (and more preferably, a substantial portion) of the length of the papermaking machine wet-end section 10 parallel to the machine direction of the wire 16. Preferably, the dovetail support member 126 permits additional devices 28 to be mounted to the papermaking machine frame 12 and/or permits adjustment of the position of the devices 28 along the papermaking machine frame 12.

As shown in FIG. 6*a*, the top plate 118 of each of the brackets 114*a* and 114*b* is preferably a horizontal plate coupled to the bottom plate 117 via the vertical adjustment mechanism 120. The vertical adjustment mechanism 120 preferably includes a threaded rod 128*a* and a threaded aperture 128*b* on each end of the truss 110. As shown in FIG. 5, the brackets 114*a* and 114*b* are each coupled to the truss 110 by the threaded rod 128*a* passed through at least part of the bracket 114*a*, 114*b* and through the threaded aperture 128*b* in the truss 110. A nut 130 on each of the threaded rods 128*a* can be turned to change the height of the truss 110 in the brackets 114*a*, 114*b*. The threaded rod 128*a* can also include a mechanical stop (such as a collar, pin, or another nut secured in a desired position on the threaded rod 128*a*, not shown) to prevent the vertical adjustment mechanism 120 from being used to raise the vibrational device 100 above a pre-determined vertical orientation with respect to the wire 16. Most preferably, the mechanical stop prevents the vibrational device 100 from being raised to a position in which the vibrational device 100 will damage or break through the wire 16. Preferably, the vertical adjustment mechanism 120 is used to help provide proper contact between the vibrational device 100 and the wire 16. If desired, the vertical adjustment mechanism 120 in each of the brackets 114*a* and 114*b* can be adjusted independently in order to adjust for any differences in the vertical height of each side of the papermaking machine frame 12 with respect to the wire 16.

A dovetail connection between a bracket 114*a*, 114*b* and the papermaking machine frame (or the floor) is a highly preferred manner in which to connect the horizontal truss 110 to the papermaking machine frame (or the floor). One having ordinary skill in the art will appreciate that a number of other manners exist for establishing this connection, some permitting adjustment of the connection location as mentioned above, and others not permitting such adjustment. By way of example only, each bracket 114*a*, 114*b* can be attached to the papermaking machine frame or floor by bolts, rivets, pins, screws, nails, or other conventional fasteners, by welding or brazing, by one or more clips or clamps, and the like. Some of the manners of connection permit adjustment of the position of the brackets 114*a*, 114*b*, such as bolts or pins releasably received within different apertures along the papermaking machine frame, clips or clamps holding the brackets 114*a*, 114*b* to a rail, lip, bar, flange, or other portion of the papermaking machine frame, and the like. In some embodiments, the brackets 114*a*, 114*b* can be retained in different positions along the papermaking machine frame by the weight upon the brackets 114*a*, 114*b*. Detents, recesses, notches, or other features of the papermaking machine frame can assist in retaining the brackets 114*a*, 114*b* in desired positions in such cases.

Figure 6B:
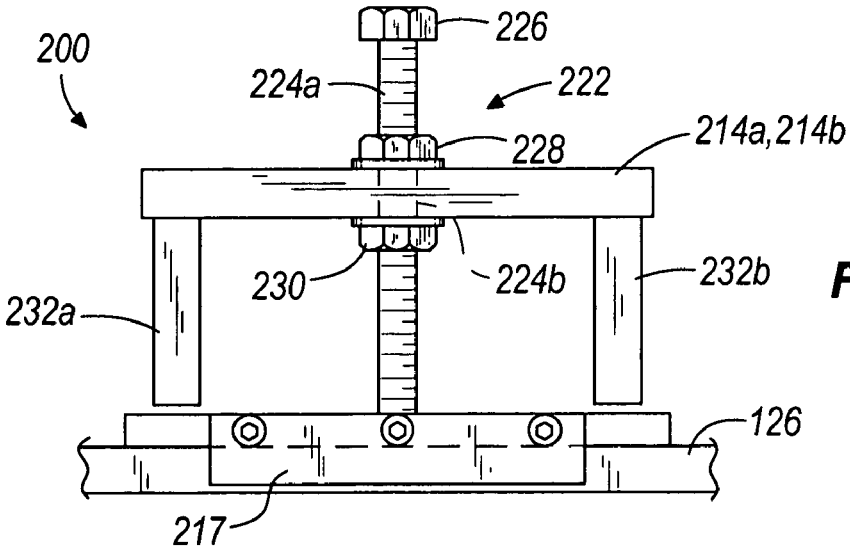
FIG. 6*b* is a side elevational view of the vertical adjustment mechanism of the vibrational device illustrated in FIG. 5*c*, viewed from line 6*b*—6*b* of FIG. 5*c;*

FIG. 6*b* is a side elevational view of the vibrational device 200 illustrated in FIG. 5*b*. As shown in FIG. 6*b*, the second horizontal truss 214 is coupled to a vertical adjustment mechanism 222. The vertical adjustment mechanism 222 includes a threaded rod 224*a* passed through a threaded aperture 224*b* in the second horizontal truss 214. The threaded rod 224*a* is preferably coupled to a bottom plate 217 in order to couple the vertical adjustment mechanism 222 to the dovetail support member 126 of the papermaking machine frame 12. The second horizontal truss 214 is secured to the threaded rod 224*a* by a top nut 226 and a bottom nut 228. The threaded rod 224*a* can also include an adjustment nut 230 that can be turned to change the height of the second horizontal truss 214 with respect to the papermaking machine frame 12. If desired, one or more supports 232*a* and 232*b* can be coupled to the second horizontal truss 214 to prevent the second horizontal truss 214 from being adjusted below a predetermined level.

Figure 6C:
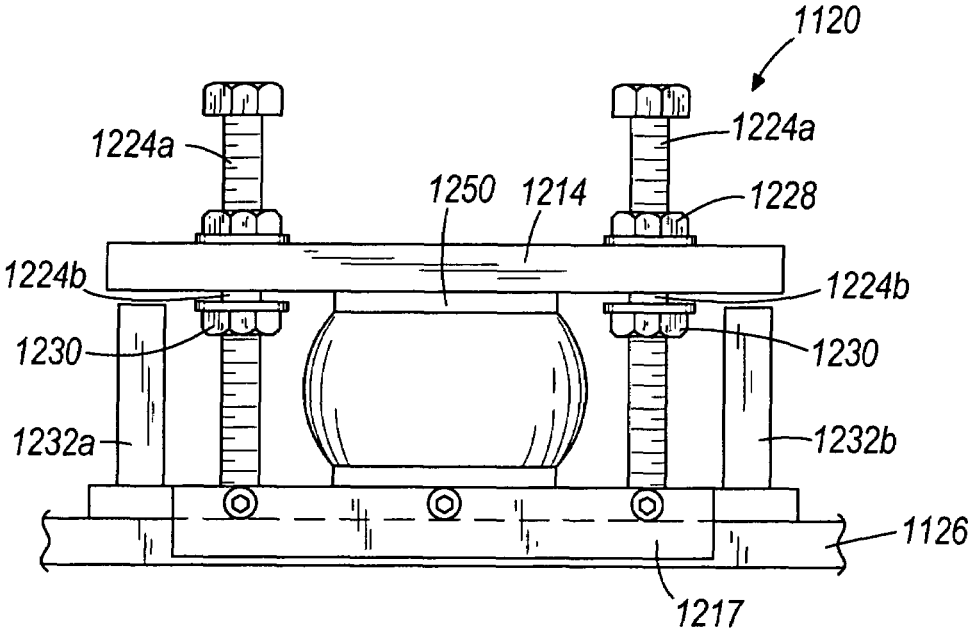
FIG. 6*c* is a side elevational view of a vertical adjustment and isolation mechanism according to another embodiment of the present invention.

FIG. 6*c* is a side elevational view of another vertical adjustment and isolation mechanism 1120 which is an alternative embodiment of the vertical adjustment mechanisms 120 and 222 shown and described above with respect to FIGS. 6*a* and 6*b*. With the exception of mutually inconsistent elements and features between the embodiments of FIGS. 6*a* and 6*b* and the embodiment of FIG. 6*c*, reference is made to the description above regarding the vertical adjustment mechanisms 120, 222 described earlier for a more complete understanding of the elements, features, and alternatives of the mechanism 1120 illustrated in FIG. 17. Also, elements and features of the vertical adjustment and isolation mechanism 1120 illustrated in FIG. 17 having a form, structure, or function similar to that found in the vertical adjustment mechanisms 120 and 222 shown and described with respect to FIGS. 6*a* and 6*b* are given corresponding reference numbers in the 1000 series.

Referring to FIG. 6*c*, a dovetail support member 1126 can be coupled to a papermaking machine frame (not shown). The vertical adjustment and isolation mechanism 1120 can be coupled to the dovetail support member 1126 and a horizontal truss 1214 of any type described herein. In some embodiments, the vertical adjustment and isolation mechanism 1120 includes two threaded rods 1224*a* passing through two threaded apertures 1224*b* in the horizontal truss 1214. The threaded rods 1224*a* can be coupled to a bottom plate 1217 in order to couple the vertical adjustment and isolation mechanism 1120 to the dovetail support member 1126 of the papermaking machine frame. The horizontal truss 1214 can be secured to the threaded rods 1224*a* by nuts 1228. The threaded rods 1224*a* can also include adjustment nuts 1230 that can be turned to change the minimum height of the horizontal truss 1214 with respect to the papermaking machine frame. If desired, one or more supports 1232*a* and 1232*b* can also be coupled to the horizontal truss 1214 to prevent the horizontal truss 1214 from being adjusted below a predetermined level.

As shown in FIG. 17, the vertical adjustment and isolation mechanism 1120 also includes a vibrational isolator 1250. The vibrational isolator 1250 can at least partially isolate the papermaking machine frame from vibrations of any one of the vibrational devices 100, 200, 1000, and likewise, to at least partially isolate any one of the vibrational devices 100, 200, 1000 from vibrations of the papermaking machine frame. In some embodiments, the vibrational isolator 1250 includes one or more gas or fluid-filled bags or other gas or fluid-filled deformable elements positioned between the horizontal truss 1214 and the bottom plate 1217 and/or the dovetail support member 1126. In other embodiments, the vibrational isolator 1250 can be a pad, block, or other element made from a resilient compressible and vibration-damping material such as rubber, plastic, urethane, wool, cork, and the like positioned between the horizontal truss 1214 and the bottom plate 1217 and/or the dovetail support member 1126. Any other conventional vibration isolator can instead be used as desired.

It should be noted that the various manners described above for adjustably positioning the horizontal truss 110 (via the brackets 114*a*, 114*b*, second horizontal trusses 214*a*, 214*b*, 1214*a*, 1214*b*, and the like) apply equally to alternative embodiments of the present invention (e.g., in which no brackets 114*a*, 114*b* are employed or in which the vibrational device has no identifiable second horizontal trusses 214*a*, 214*b*, 1214*a*, 1214*b*). In such cases, the ends of the horizontal truss 110, 210 can be permanently or adjustably connected to different locations on the papermaking machine frame or to the ground.

A number of different elements and structures exist for adjusting the height of the horizontal truss 110, 210 at either or both ends thereof. The jackscrew-type vertical adjustment mechanisms 120, 222 described above and illustrated in the figures are well-suited for brackets 114*a*, 114*b* or second horizontal trusses on the ends of the truss 110, 210. In other embodiments (whether employing brackets 114*a*, 114*b*, second horizontal trusses 214*a*, 214*b*, 1214*a*, 1214*b* or other structure), the ends of the horizontal truss 110, 210 can be lifted and lowered by any conventional jack mechanism, including without limitation by ratchet or scissor-type jacks connected between the papermaking machine frame or ground and the truss, by conventional hydraulic, pneumatic, or electrical jacks, by shims, by one or more bladders fillable with air or fluid, and the like. One having ordinary skill in the art will appreciate that still other examples of adjusting the height of the truss 110, 210 are possible, each one of which falls within the spirit and scope of the present invention.

Preferably, the brackets 114*a* and 114*b* or second horizontal trusses 214*a*, 214*b*, 1214*a*, 1214*b* also include a vibrational isolator (not shown) to isolate the machine frame 12 from any vibrations of the vibrational device 100, 200, 1200 and, likewise, to isolate the vibrational device 100, 200, 1200 from any vibrations of the papermaking machine frame 12. In one highly preferred embodiment, the vibrational isolator is a pad, block, or other element made from a compressible and vibration-damping material such as rubber, plastic, urethane, wool, cork, and the like positioned between steel blocks within the brackets 114*a* and 114*b* or against the second horizontal trusses 214*a*, 214*b*, 1214*a*, 1214*b*. In other embodiments, the vibrational isolator is an gas or fluid bag positioned within the brackets 114*a* and 114*b* or against the second horizontal trusses 214*a*, 214*b*, 1214*a*, 1214*b*. Vibration isolators can also be used in those embodiments of the present invention not having brackets 114*a*, 114*b* or second horizontal trusses 214*a*, 214*b*, 1214*a*, 1214*b* as described above. Any other conventional vibration isolator can instead be used as desired.

Preferably, the vibrational device frame 102, 202, including the horizontal truss 110, 210 and the diagonal trusses 112*a* and 112*b* and brackets 114*a* and 114*b* (if used) or the vertical and secondary horizontal truss structure (if used), is constructed of stainless steel. Most preferably, the vibrational device frame 102, 202 is constructed of 316 stainless steel, because 316 stainless steel is largely inert to the caustic and acidic environment of the papermaking machine.

The following description is with reference to the vibrational device 100 illustrated in FIGS. 4 and 5*a*, it being understood, however, that the various elements, structures, operational features, and alternatives described below apply equally to the vibrational device embodiment illustrated in FIGS. 5*b* and 5*c*.

With reference again to the embodiment of the present invention illustrated in FIGS. 4 and 5*a*, the vibrational device 100 preferably includes at least one vibration-inducing mechanism 104. More preferably, the vibrational device 100 includes multiple vibration-inducing mechanisms 104 positioned across the width (i.e. cross-machine direction) of the wire 16. Preferably, the vibration-inducing mechanisms 104 are coupled to the vibrational head 106, but not to the vibrational device frame 102. As with the embodiment illustrated in FIG. 5*b*, three vibration-inducing mechanisms 104 are preferably equally spaced across the width of the wire 16 and are coupled to the vibrational head 106 via a plurality of bolts 132. Other numbers and spacings of the vibration-inducing mechanisms 104 can be employed if desired. The vibration-inducing mechanisms can be attached to the vibrational head 106 in other manners, such as by rivets, pins, clips, clamps, nails, buckles, clasps, or other conventional fasteners, by welding, brazing, or adhesive, by threaded, snap-fit, or other inter-engaging connections, and the like.

In some preferred embodiments, one vibration-inducing mechanism 104 is positioned every one to four feet across the width of the wire 16. For example, for a typical wire 16 having a width of 30 feet, preferably ten vibration-inducing mechanisms 104 are positioned across the width of the wire 16. The number of vibration-inducing mechanisms 104 positioned across the width of the wire 16 is at least partially a function of the power output of each vibration-inducing mechanism 104 and the physical size of each vibration-inducing mechanism 104. However, any number of vibration-inducing mechanisms 104 could be positioned across the width of the wire 16 in any suitable configuration.

The vibration-inducing mechanisms 104 are preferably any type of pneumatic, hydraulic, electric, mechanical or electromagnetic mechanisms that are able to impart a force having a relatively high frequency and a relatively low amplitude to the wire 16. Vibrators and vibration-inducing mechanisms driven pneumatically, hydraulically, electrically, mechanically, or electro-mechanically are well-known to those skilled in the art, and are not therefore described further herein. In some preferred embodiments, the vibration-inducing mechanisms 104 each impart a force of approximately 20 to 7000 pounds with a frequency of approximately 20 to 2000 Hertz and an amplitude of up to approximately 0.120 inches. However, superior results are achieved when the vibration-inducing mechanisms vibrate at a frequency of at least 1,000 Hertz. Also, the amplitude of the vibrational force may be adjusted so that the vibrational head 106 has a range of vibrational movement and is in direct contact with the wire 16 in only part of the range of vibrational movement. In general, the heavier the weight of the paper being produced and/or the faster the speed of the papermaking machine, the greater the force necessary to vibrate the wire 16. However, the frequencies and amplitudes of the vibrational forces transferred to the wire 16 are preferably independent of the speed at which the wire 16 is travelling (i.e., the papermaking machine speed).

In some embodiments, each one of the vibration-inducing mechanisms 104 is controlled individually so as to impart different forces having different frequencies and/or different amplitudes to different sections of the wire 16 across the width (i.e., the cross-machine direction) of the wire 16. For example, a first vibration-inducing mechanism 104 generates a first vibrational force having a first frequency, and a second vibration-inducing mechanism 104 generates a second vibrational force having a second frequency different from the first frequency. The first vibrational force is transferred to a first section of the wire 16 in the cross-machine direction, and the second vibrational force is transferred to a second section of the wire 16 in the cross-machine direction. The first and second vibrational forces may also have different amplitudes. The frequency and amplitude of the first vibrational force may be controlled independently of the frequency and amplitude of the second vibrational force, and vice versa, so that the frequencies and amplitudes of the vibrational forces may be changed independently during operation of the vibrational device 100, 200. Moreover, the frequencies and amplitudes of the different vibrational forces transferred to the wire 16 in the cross-machine direction are preferably each independent of the speed at which the wire 16 is traveling (i.e., the papermaking machine speed).

By varying the frequencies and amplitudes of the vibrational forces transferred to different sections of the wire 16, the quality of the paper web can be more precisely controlled in the cross-machine direction. For example, the quality of the center of the paper web may be acceptable, but the quality of the edges of the paper web may not be acceptable. In this case, the vibration-inducing mechanisms 104 corresponding to the edges of the paper web may be adjusted to transfer vibrational forces having higher frequencies and/or amplitudes to the edges of the wire 16. In addition, the vibration-inducing mechanisms 104 corresponding to the center of the paper web may be adjusted to transfer vibrational forces having lower frequencies and/or amplitudes to the center of the wire 16. Moreover, the vibration-inducing mechanisms 104 corresponding to the center of the paper web may be turned off or adjusted to not transfer vibrational forces to the center of the wire 16.

The type of vibration-inducing mechanisms 104 used in each application could vary depending upon the type of power source available near the papermaking machine. Each type of vibration-inducing mechanism 104 can be implemented within the vibrational device 100 in the same manner. Most preferably, the vibration-inducing mechanisms 104 are pneumatic turbine vibrators manufactured by Vibco, Inc. of Wyoming, R.I. The most preferred Vibco pneumatic turbine vibrators for use as the vibration-inducing mechanisms 104 are series CCF-L-, W, V, BV, SVR, and HLF. The Vibco pneumatic turbine vibrators are manufactured under one or more of the following patents, the disclosures of which are incorporated herein by reference: U.S. Pat. Nos. 3,870,282; 3,932,057; 3,938,905; 4,389,120; and 4,424,718 insofar as they relate to vibrator devices, their structure, and operation.

The vibrational device 100 illustrated FIGS. 5*a* and 5*c* is described above as having pneumatic vibration-inducing mechanisms by way of example only. As also described above, the vibration-inducing mechanisms can take a number of other forms. With reference to FIGS. 5*a* and 5*c*, fluid or gas (preferably air) is preferably supplied via a plurality of lines 170 to the pneumatic vibration-inducing mechanisms 104. The plurality of air lines 170 can be coupled to the horizontal truss 110, if desired. In one preferred embodiment, the plurality of air lines 170 are coupled to an air supply through a flow meter 172, a regulator 174, and a valve 176 in order to control the pressure and rate of the air supplied to the pneumatic vibration-inducing mechanisms 104. Other conventional pneumatic systems can instead be used to also control the pressure, rate, and volume of the air supplied to the pneumatic vibration-inducing mechanisms 104. In one preferred embodiment, air is supplied to the pneumatic vibration-inducing mechanisms 104 at approximately 80 pounds per square inch and 40 cubic feet per minute. One skilled in the art will recognize that other air supply pressures, rates, and volumes could be used to generate suitable vibrational forces, each one of which falls within the spirit and scope of the present invention. Preferably, the vibration-inducing mechanisms 104 each include a conventional solenoid valve (not shown) coupled to the air supply lines 170 in a conventional manner. The solenoid valve preferably regulates the amplitude and frequency of the vibration-inducing mechanisms 104, thus regulating the amplitude and frequency of the vibrational head 106 itself.

Figure 5D:
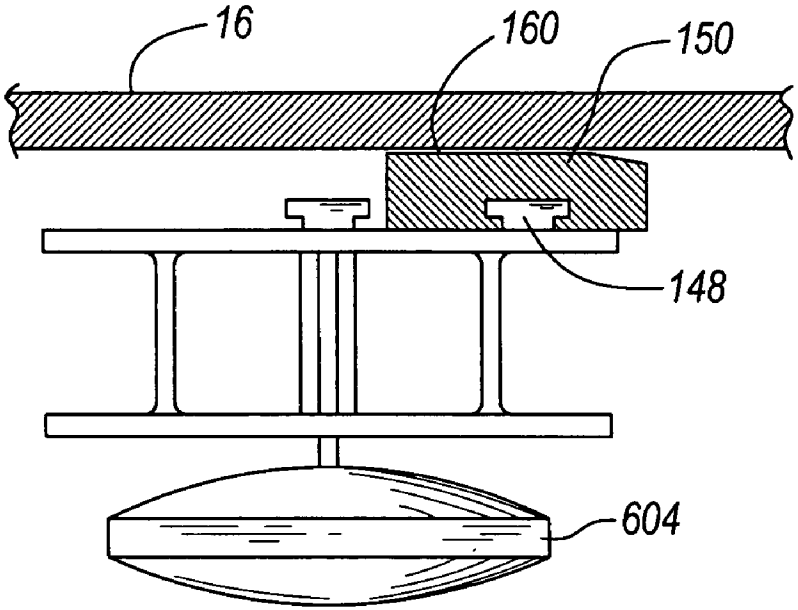
FIG. 5*d* is a detail side view of an alternative vibrational device according to the present invention.

FIG. 5*d* illustrates another vibration-inducing mechanism 604 according to the present invention. The vibration-inducing mechanism 604 of FIG. 5*d* is an electromagnetic, vibration-inducing mechanism having a tactile-sound transducer. The transducer uses a magnet structure to produce a force output per energy input over a wide range of frequencies (e.g., 15 Hertz–17,000 Hertz), although superior results can be obtained at frequencies over 1,000 Hertz. Using this type of vibration-inducing mechanism 604, the amplitude and the frequency of the output can be easily controlled for each individual vibration-inducing mechanism 604. Preferably, the vibration-inducing mechanism 604 operates at a frequency independent of the speed at which the wire 16 is traveling (i.e., machine speed). If desired, one or more conventional electronic amplifiers (not shown) can be used to control the rate of vibration of each independent vibration-inducing mechanism 604 or for all of the vibration-inducing mechanisms 604 in series.

Referring again to the illustrated preferred embodiment of FIGS. 5*a* and 5*c*, the vibrational device 100 includes at least one vibration isolator 105 coupled between the horizontal truss 110 and the vibrational head 106, although such an isolator is not required to practice the present invention. More preferably, the vibrational device 100 includes a plurality of vibration isolators 105 coupled in this manner. The plurality of vibration isolators 105 at least partially isolate the vibrational device frame 102 from the vibrations generated by the vibration-inducing mechanisms 104. The vibration isolators 105 can be positioned in any manner in the vibrational device 100. Preferably however, one vibration isolator 105 is positioned on either side of each vibration-inducing mechanism 104. In the highly preferred embodiment illustrated in FIGS. 5*a* and 5*c*, four vibration isolators 105 are positioned along the horizontal truss 110 on either side of the three vibration-inducing mechanisms 104. Other vibration isolator arrangements are possible. With reference to the embodiment of the present invention illustrated in FIG. 5*b* for example, multiple vibration isolators 205 can be positioned along the horizontal truss 210 on either side of the vibration-inducing mechanisms 204 in order to further increase machine direction stability for the vibrational device 200.

Figure 7A:
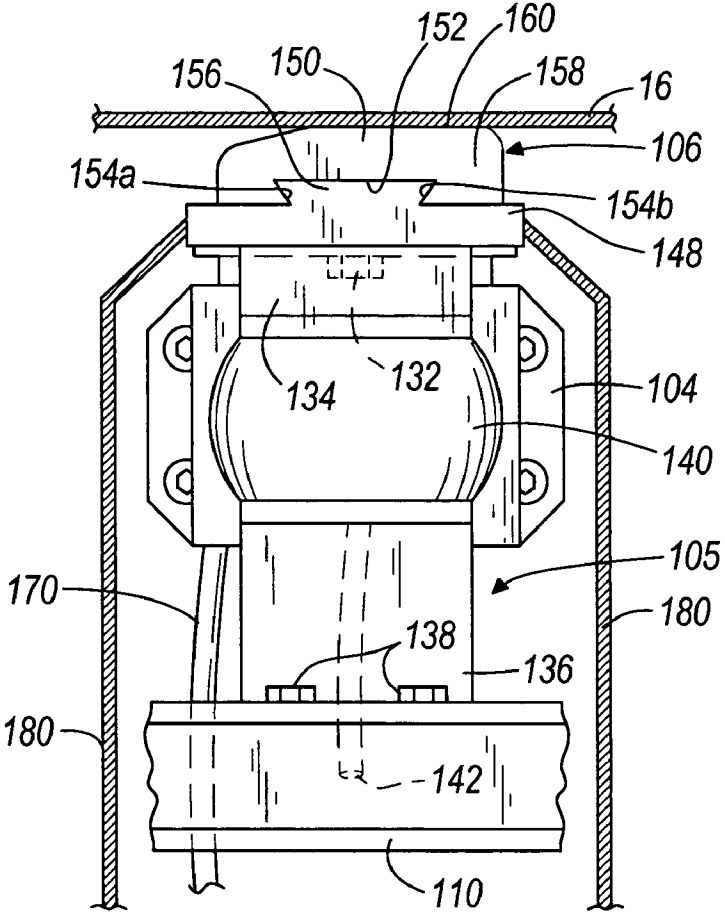
FIG. 7*a* is a cross-sectional view of the vibrational device shown in FIG. 5*a*, taken along line 7*a*—7*a* of FIG. 5*a;*
Figure 7B:
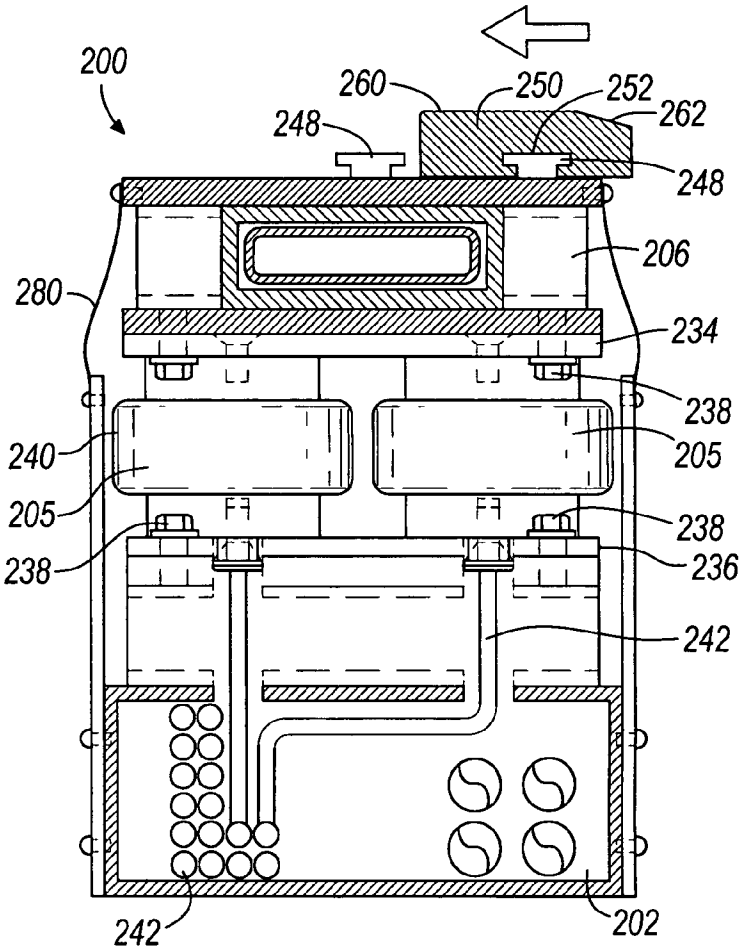
FIG. 7*b* is a cross-sectional view of the vibrational device shown in FIG. 5*b*, taken along line 7*b*—7*b* of FIG. 5*b;*
Figure 7C:
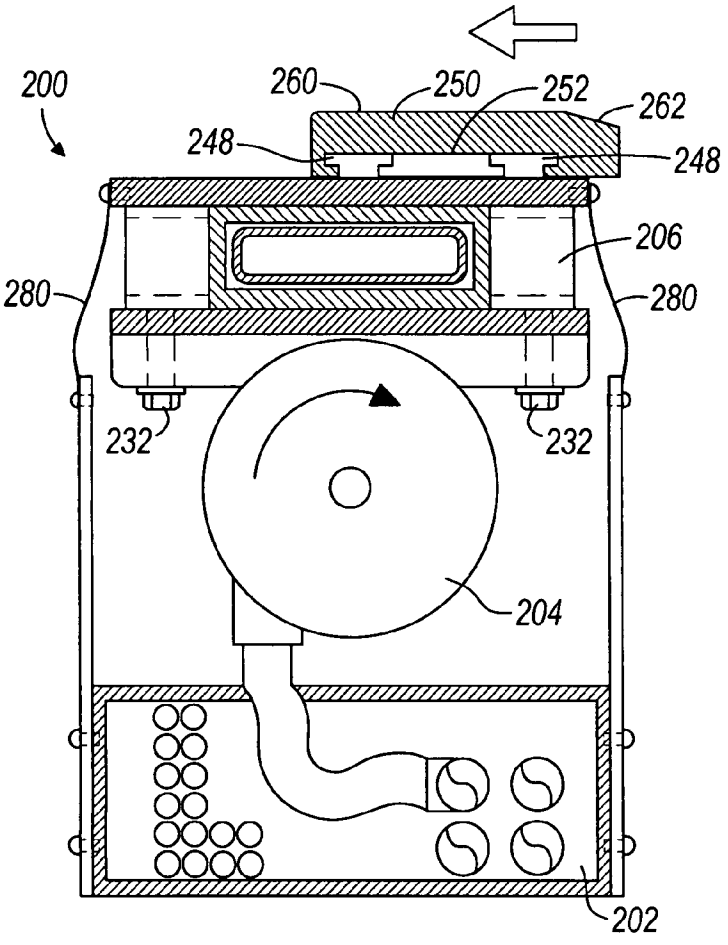
FIG. 7*c* is a cross-sectional view of the vibrational device shown in FIG. 5*c*, taken along line 7*c*—7*c* of FIG. 5*b;*

With reference to both illustrated preferred embodiments of the present invention illustrated in FIGS. 5*a*–5*b*, the vibration isolator 105, 205 is preferably coupled between the horizontal truss 110, 210 and the vibrational head 106, 206 (see FIGS. 7*a*–7*c*). The vibration isolator 105, 205 preferably includes an upper bracket 134, 234 coupled to the vibrational head 106, 206, a lower bracket 136, 236 coupled to the horizontal truss 110, 210 via bolts 138, 238, and an air bag 140, 240 coupled between the upper bracket 134, 234 and the lower bracket 136, 236. A fluid or a gas (preferably air) is supplied to the bag 140, 240 via a hose 142, 242 coupled to an air source (as shown in FIGS. 5*a* and 5*b*). Air supplied to the air bag 140, 240 is regulated to keep the air bag 140, 240 at a pressure high enough to absorb vibrational frequencies generated by the vibration-inducing mechanisms 104, 204 and to support the vibrational head 106, 206, but low enough so as not to impart an additional force to the vibrational head 106, 206. In some preferred embodiments, the air bag 140, 240 is kept at a gauge pressure of 5 to 20 pounds per square inch. In some highly preferred embodiment, the air bag 140, 240 is also used to control the height of the vibrational head 106, 206 by varying the input air pressure to the air bag 140, 240. Also in some highly preferred embodiments, each air bag 140, 240 is independently supplied with air pressure such that the height of the vibrational head 106, 206 can be adjusted differently at various positions across the width of the wire 16.

The vibration isolators 105, 205 can be connected to the vibrational head 106, 206 and to the horizontal truss 110, 210 in a number of different manners, including those described above with reference to the connection between the vibration-inducing mechanisms 104, 204 and the vibrational head 106, 206.

Although the vibration isolators 105, 205 are preferably air bag vibration isolators, one having ordinary skill in the art will appreciate that other types of vibration isolators can instead be employed. For example, other vibration isolators include without limitation pneumatic springs and shocks, hydraulic springs and shocks, electromagnet sets, solenoids, torsion, extension, compression, leaf, and other springs, and the like connected in a manner similar to the air bag vibration isolators described above. While any of these types of vibration isolators can be used to dampen vibrations as also described above, controllable vibration isolators are most preferred to enable the user to control the amount of vibration damping provided by the vibration isolators. Controllable vibration isolators and their operation are well known to those skilled in the art and are not therefore described further herein.

With particular reference to FIGS. 7*a*–7*c*, the vibrational device frame 102, 202, the vibration-inducing mechanisms 104, 204, and the vibrational isolators 105, 205 are preferably covered with a sheathing material 180, 280 suitable for protecting the internal components of the vibrational device 100, 200 and for providing a smooth surface, free of recesses, corners, and protrusions. In most preferred embodiments, the vibrational head 106, 206 is the only component of the vibrational device 100, 200 that is not sheathed. Most preferably, the sheathing material 180, 280 is a thin-gauge stainless steel that drapes over the vibrational device 100, 200 and is welded onto the vibrational device frame 102, 202 or is connected thereto in any other conventional manner. However, the sheathing material 180, 280 can be any type or combination of materials compatible with the papermaking process that do not degrade from the chemicals used in the papermaking process and that do not contaminate the papermaking process.

As shown in FIG. 7*a*–7*c*, the vibrational head 106, 206 preferably includes a sliding mechanism 148, 248 and a vibrational element 150, 250 coupled to the sliding mechanism 148, 248 for engaging the wire 16. The sliding mechanism 148, 248 can be connected to the vibrational element 150, 250 in a number of different manners, such as via one of the sliding connections shown in FIGS. 7*a*–7*c*. In FIG. 7*a* for example, the sliding mechanism 148 preferably has a male dovetail configuration, including a horizontal engagement surface 152 and two diagonal engagement surfaces 154*a* and 154*b*. The sliding mechanism 148 is connectable to a female dovetail configuration 156 in the bottom surface 158 of the vibrational element 150 (although the locations of the dovetail shapes can be reversed in other embodiments). Alternatively, the vibrational head 206 can have one or more sliding mechanisms having a T, L, I, or other mating shape. In FIGS. 7*b* and 7*c*, the vibrational head 206 includes a sliding mechanism 248 having a T-slot configuration. The sliding mechanism 148, 248 can have any other configuration suitable for slidably coupling the vibrational element 150, 250 to the solenoid valves of the vibration-inducing mechanisms 104, 204. The sliding mechanism 148, 248 allows the vibrational element 150, 250 to be removed from the vibrational device 100, 200 and to be replaced, preferably even while the papermaking machine is operating.

In other embodiments of the present invention, the vibration-inducing mechanisms 104, 204 can be releasably connected to the vibrational element 150, 250 in other manners. For example, the vibration-inducing mechanisms 104, 204 can be releasably connected to the vibrational element 150, 250 by one or more conventional fasteners including one or more bolts, pins, clips, and the like, by one or more tongue and groove joints, by a flange, boss, bracket, rail, or other element or extension on the vibration-inducing mechanisms 104, 204 received within one or more grooves, slots, or other apertures in the vibrational element 150, 250 (and vice versa), and the like. In embodiments where a removable vibrational element 150, 250 is not needed or desired, the vibrational element 150, 250 can be permanently connected to the vibration-inducing mechanisms 104, 204 in any conventional manner desired.

The vibrational element 150, 250 can have any shape and size. However, in some highly preferred embodiments, the vibrational element 150, 250 has a width of approximately one to ten inches and a length approximately equal to the width of the wire 16 in the cross-machine direction. The vibrational element 150, 250 preferably has a land area 160, 260 at the plane of intersection with the wire 16. The land area 160, 260 is the area through which the vibrational force is transferred from the vibrational element 150, 250, through the bottom of the wire 16, and into the web being transported by the wire 16.

Figure 8A:
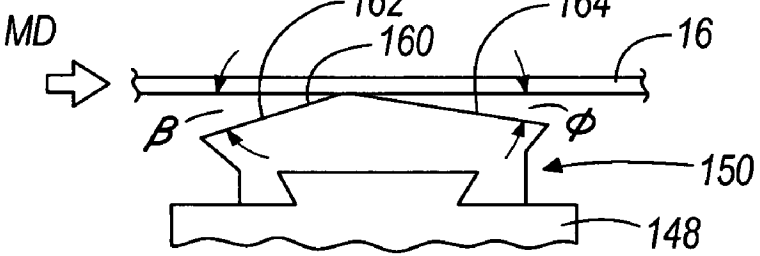
FIGS. 8*a*–8*e* are cross-sectional views of different embodiments of vibrational heads for a vibrational device according to the present invention.

In one highly preferred embodiment of the present invention shown in FIG. 8*a*, the vibrational element 150 (referring to the illustrated preferred embodiment of FIGS. 4, 5*a*, 7*a*, and 7*b* by way of example only) has a land area 160 with an upstream portion 162 and a downstream portion 164. The upstream portion 162 preferably slopes vertically downward from the wire 16 at a lead angle $\beta$ of approximately 0 to 15 degrees. The lead angle $\beta$ of the upstream portion 162 of the vibrational element 150 preferably pushes water up into the wire 16 when the vibrational element 150 engages the underside of the wire 16. The downstream portion 164 preferably slopes vertically downward from the wire 16 at a relief angle $\phi$ of approximately 0 to 5 degrees. The relief angle $\phi$ of the downstream portion 164 of the vibrational element 150 preferably induces a vacuum when the vibrational element 150 engages the underside of the wire 16. In another highly preferred embodiment of the vibrational element 150 shown in FIG. 8*b*, the land area 160 has a convex configuration having a radius R of approximately 4 to 8 inches.

Figure 8B:
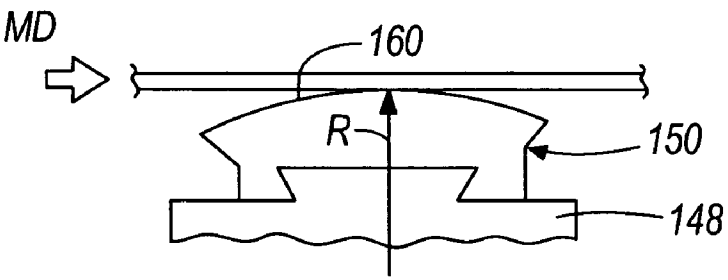
Figure 8C:
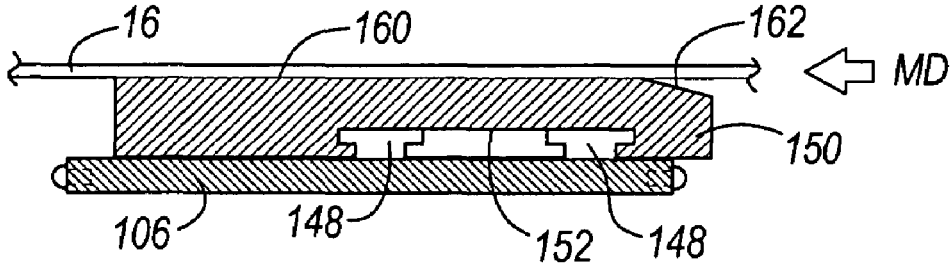
Figure 8D:
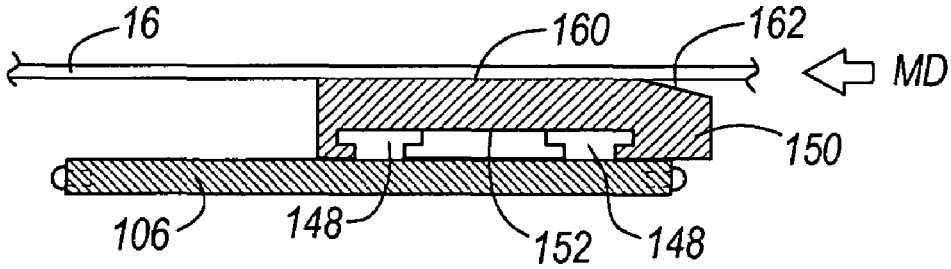
Figure 8E:
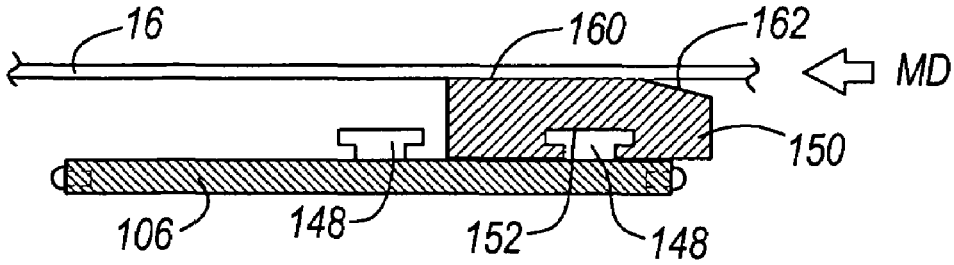

The vibrational element 150, 250 can have any configuration suitable for engaging the underside of the wire 16 and imparting a vibrational force to the underside of the wire 16. In particular, as shown in FIGS. 8*c*–8*e*, the vibrational element 150, 250 can have a generally flat configuration similar to the stationary foils 36. Also, the vibrational element 150, 250 can have various machine-direction lengths (e.g., a long length as shown in FIG. 8*c*, a medium length as shown in FIG. 8*b*, and a short length as shown in FIG. 8*c*). Alternatively, the vibrational element 150, 250 can have any cross-sectional shape and any machine-direction length desired which is capable of transmitting vibrational force to the underside of the wire 16, including without limitation rectangular, round, oval, concave, convex, wave, and irregular shapes. The cross-sectional shapes need not necessarily have sloping upstream or downstream portions as described above with reference to the vibrational elements 150 shown in FIGS. 8*a* and 8*b*.

A vibrational element 150, 250 partially or fully spanning the wire 16 in the machine direction and actuated by one or more vibration-inducing mechanisms 104, 204 is preferred.

However, vibration can be transmitted to the wire 16 from the vibration-inducing mechanisms 104, 204 in a variety of different manners. The vibration-inducing mechanisms 104, 204 can press directly against the underside of the wire 16 (e.g., at multiple points across the wire 16), can actuate separate elements in constant or intermittent contact with the underside of the wire 16, and the like. In those embodiments not having a vibrational element to which the vibration-inducing mechanisms 104, 204 can be suspended or otherwise supported, the vibration-inducing mechanisms 104, 204 can be mounted upon a rail, bar, plate, frame, or other structure located beneath the wire 16.

The manner in which the vibration-inducing mechanisms 104, 204 exert vibrational force to the underside of the wire 16 depends at least partially upon the type of vibration-inducing mechanisms being used. For example, many conventional vibration-inducing mechanisms have base plates through which generated vibration is transmitted. These vibration-inducing mechanisms can be employed in the vibrational device 100, 200 of the present invention, and can be mounted on a frame or other structure so that their bases are in direct or indirect vibration-transmitting contact with the underside of the wire 16. As another example, one or more solenoids having extendible armatures can be mounted across the underside of the wire 16 so that the armatures can extend into contact with the underside of the wire 16 when the solenoids are actuated. As yet another example, a shaft having multiple cams thereon can be rotatably mounted across the underside of the wire 16 so that rotation of the shaft causes the cams to come into repeated contact with the wire 16 to vibrate the wire 16.

The vibrational device 100, 200 can include two or more independent vibrational heads 106, 206 mounted to a single vibrational device frame 102, 202 (see FIG. 5*b*, for example). Each independent vibrational head 106, 206 can have independent vibration-inducing mechanisms 104, 204 coupled to the single vibrational device frame 102, 202 and one or more vibrational isolators 105, 205 mounted between the vibrational heads 106, 206 and the vibrational device frame 102, 202. For example, as shown in FIG. 5*b*, three vibrational heads 206 are coupled to the vibrational device frame 202. Each one of the three vibrational heads 206 may transfer a different vibrational force to a different section of the wire 16 by independently controlling the frequencies and amplitudes of the vibrational forces generated by each one of the three vibration-inducing mechanisms 204. One having ordinary skill in the art will appreciate that still other manners of transmitting vibrational force to the underside of the wire 16 are possible and can be employed as alternatives to the preferred vibrational element 150, 250, vibration-inducing mechanisms 104, 204, and horizontal truss 110, 210 described above and illustrated in the figures. Each of these alternatives is considered to fall within the spirit and scope of the present invention.

Preferably, the vibrational head 106, 206 is a rigid structure capable of transferring a consistent vibrational force from the vibration-inducing mechanism 104, 204 to the vibrational element 150, 250. The vibrational head 106, 206 can be constructed of any material desired, and is preferably constructed of a relatively rigid material such as steel, fiberglass, composites, or combinations thereof. The vibrational head 106, 206 can include plates, angles, tubes, honeycomb or mini-truss elements, or other structural members fastened to the vibrational isolators 105, 205 or the papermaking machine frame 12 in any conventional manner, such as by welding, brazing, pinning, laminating, or bolting. One having ordinary skill in the art will appreciate that still other examples of materials and designs for the vibrational head 106, 206 are possible.

The vibrational element 150, 250 can be constructed of any material that is preferably less abrasive than the material of the wire 16. Preferably, the vibrational element 150, 250 is constructed of material that wears well, in addition to being less abrasive than the material of the wire 16. Most preferably, the vibrational element 150, 250 is constructed of ultra-high, molecular-weight (UHMW) polyethylene.

As best shown in the illustrated preferred embodiment of FIGS. 1 and 2, in addition to the vibrational devices 100, some highly preferred embodiments of the present invention include one or more lubrication showers 121 positioned upstream from the vibrational device 100. The lubrication shower 121 preferably spans the entire cross-machine direction width of the wire 16. The lubrication shower 121 directs water into the pinch point (i.e., the nip) caused when the vibrational element 150 engages the underside of the traveling wire 16. Preferably, the lubrication shower 121 includes a water pipe, tube, chamber, or other conduit and a plurality of fan-type nozzles (not shown) connected thereto for injecting a sufficient amount of water so as to act as a non-compressible media capable of penetrating through the wire 16 and into the web. In some preferred embodiments, the lubrication shower 121 includes high-pressure needle showers that oscillate with a sufficient spray pattern to cover the entire width of the wire 16. The water from the lubrication shower 121 minimizes the premature wear of both the wire 16 and the vibrational element 150 by minimizing the friction between the two. In some highly preferred embodiments, the water supplied by the lubrication shower 121 carries the vibrational energy from the vibrational element 150, through the wire 16, and into the stock flow.

According to the method of the invention, the vibrational device 100, 200 is used to impart a vibrational force to the underside of the wire 16 in order to create turbulence within the stock flow. Preferably, this vibrational force is a high frequency, low amplitude force. Creating turbulence within the stock flow keeps the fibers within the stock flow in free suspension, i.e., prevents the fibers from bonding to one another, for a longer period of time. Preferably, sufficient turbulence is created to cause the free suspension of fibers having a length of from approximately 0.5 mm to approximately 12 mm. In order to excite and re-align the fibers, the fibers preferably must be moved a distance equal to at least their length. Thus, sufficient turbulence is created to move the fibers approximately 0.5 mm to approximately 12 mm. During this added time of free suspension or re-fluidization, the fibers are able to re-align with respect to one another. Once the fibers begin to bond to one another after being re-aligned, the fibers re-settle on the wire 16 in a more uniform pattern and penetrate into empty voids in which fibers had not yet settled. This resettling of the fibers results in more consistent fiber distribution in the cross-machine direction, the machine direction, and the Z direction.

High levels of turbulence, although beneficial for good formation, can result in the low retention of fines and fillers in the web due to the disruption of the matted web. However, inter-slurry fiber collisions and collisions between fibers and the wire 16 which occur in increased states of turbulence can have a beneficial influence on the retention of fines and fillers within the web. In addition to creating turbulence within the stock flow, the vibrational force imparted to the underside of the wire 16 by the vibrational device 100, 200, along with the water delivered by the lubrication shower 121, helps to release boundary layer fibers that may have become impregnated in the wire 16 due to the delivery of the stock flow to the wire 16 at the angle of impingement $\alpha$, especially in a pressure forming arrangement of the headbox 14.

Figure 9B:
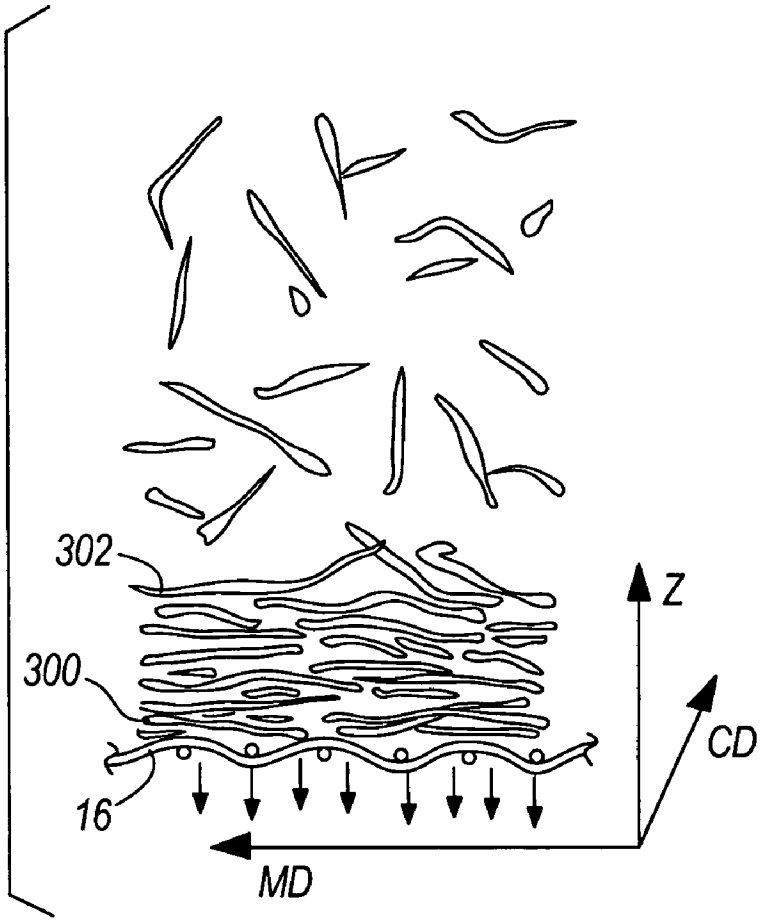
FIG. 9*b* is a schematic representation of stock flow settling on a wire with a vibrational force.
Figure 9A:
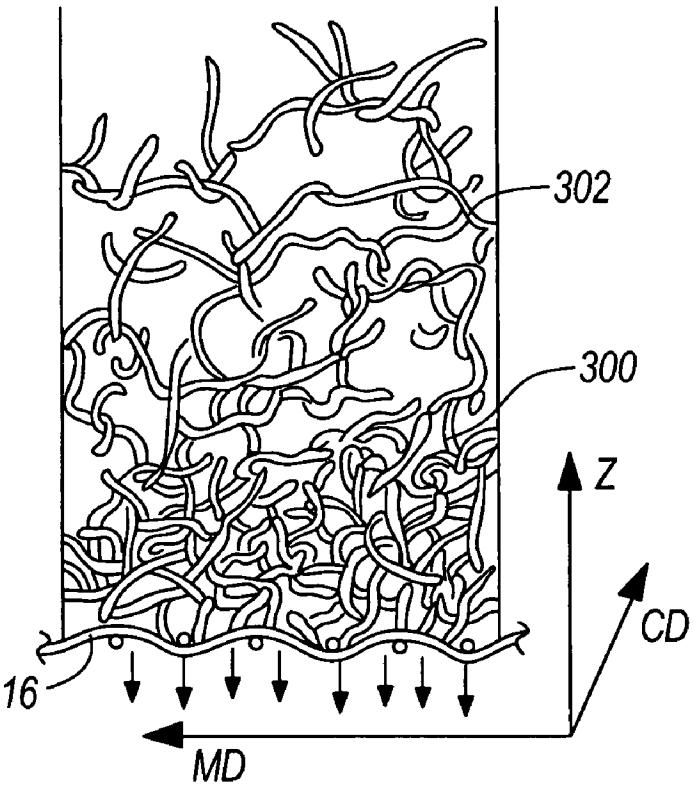
FIG. 9*a* is a schematic representation of stock flow settling on a wire without a vibrational force.

As shown in FIG. 9*a*, when a vibrational force is not imparted to the wire 16, the fibers within the stock flow begin to bond to one another and settle on the wire 16 in a non-uniform manner as water drains downwardly through the wire 16. The bottom-most layers of fibers 300 are much more dense than the upper-most layers of fibers 302. In addition, the upper-most layers of fibers 302 often lack moisture, due to water draining downwardly through the wire 16. As shown in FIG. 9*b*, when a vibrational force is imparted to the wire 16 by the present invention, the fibers settle on the wire 16 in a more uniform pattern. In addition, the bottom-most layers of fibers 300 are more uniform in density with the upper-most layers of fibers 302 because the fibers re-settle on the wire 16 filling empty voids as the web forms.

In either a pressure forming or a velocity forming arrangement of the headbox 14, water removal and boundary layer fiber bonding normally commences as soon as the stock flow contacts the wire 16. The vibrational device 100, 200 therefore preferably imparts vibrational force to the underside of the wire 16 before an embryonic web is substantially formed. If the vibrational device 100, 200 imparts the vibrational force to the underside of the wire 16 after the embryonic web has substantially formed, the vibrational force may damage or destroy the web. Accordingly, some embodiments of the present invention employ the vibrational devices 100, 200 are preferably positioned within the papermaking machine wet-end section 10 so that the vibrational forces are imparted to the wire 16 before a significant amount of water is removed from the stock flow as distributed by the headbox 14 and before significant formation of the embryonic web. The stock flow distributed onto the wire 16 by the headbox 14 is preferably 99 percent water and 1 percent fibers, although stock flows having different consistencies can be used. Preferably, the vibrational devices 100, 200 are positioned within the papermaking machine wet-end section 10 so that vibrational forces are imparted to the wire 16 before the web has a fiber consistency of 5 percent and a water consistency of 95 percent, i.e., during the formation of the embryonic web.

Moreover, the lubrication shower 121 (if used) preferably injects a sufficient amount of water into the wire 16 so as to act as a non-compressible media that reduces wear of both the vibrational element 150, 250 and the wire 16. The water injected by the lubrication shower 121 is preferably capable of penetrating through the wire 16 and into the web to help release boundary layer fibers impregnated in the wire 16 and to help maintain the free suspension of the fibers (i.e., aid in re-fluidization) in order to prevent or at least delay the formation of the embryonic web.

In some preferred embodiments of the present invention, at least one vibrational device 100, 200 is installed within the wet-end section 10 of an existing papermaking machine. The vibrational devices 100, 200 in the illustrated preferred embodiments of FIGS. 1–8*e* are preferably installed into the papermaking machine wet-end section 10 by sliding the female dovetail configuration of the vertical adjustment mechanism 120, 222 over the male dovetail support member 126 of the papermaking machine frame 12. Preferably, if more than one vibrational device 100, 200 is installed, the vibrational devices 100, 200 are separated by at least one foil box 32, and thus, a plurality of stationary foils 36. Most preferably, a first vibrational device 100, 200 is positioned between the initial forming board 30 and the first of the plurality of foil boxes 32 and a second vibrational device 100, 200 is positioned between the second of the plurality of foil boxes 32 and the third of the plurality of foil boxes 32. However, any number of vibrational devices 100, 200 of the present invention can be installed at any location along the wet-end section 10 of the papermaking machine and between any of the stationary foils or forming boards along the wet-end section 10.

If additional dwell time is required for formation of the web after the vibrational device 100, 200, auxiliary forming boards (not shown) can be installed downstream from the vibrational device 100, 200. The auxiliary forming boards can replace some of the plurality of stationary foils 36 or can be added to the papermaking machine wet-end section 10 in addition to the plurality of stationary foils 36. Auxiliary forming boards or the plurality of stationary foils 36 can also be an integral part of the vibrational device 100, 200 itself. In addition, existing forming boards 30 can be modified to incorporate the principles of the vibrational device 100, 200 of the present invention.

In some preferred embodiments, after the vibrational device 100, 200 is installed, the vertical orientation of the vibrational device 100, 200 with respect to the wire 16 can be adjusted. In order to adjust the vertical orientation in the illustrated preferred embodiment, an operator rotates the adjustment nut 130, 230 of the vertical adjustment mechanism 120, 222. The adjustment nut 130, 230 adjusts the threaded rod 128*a*, 224*a* in the threaded aperture 128*b*, 224*b* of the horizontal truss 110, 210, thereby raising or lowering the horizontal truss 110, 210 with respect to the papermaking machine frame and the wire 16.

Preferably, the vertical orientation of the vibrational device 100, 200 is adjusted until the vibrational element 150, 250 engages the underside of the wire 16. Most preferably, the vertical orientation of the vibrational device 100, 200 is adjusted until the vibrational element 150, 250 raises the wire 16 by approximately 0.001 to 0.002 inches. However, the vibrational device 100, 200 can be adjusted so that the vibrational element 150, 250 does not actually contact and engage the wire 16. Also, the vertical orientation of the vibrational device 100, 200 may be adjusted so that the vibrational head 106, 206 has a range of vibrational movement and is in direct contact with the wire 16 in only part of the range of vibrational movement. One skilled in the art will recognize that the vertical adjustment of the vibrational device 100, 200 can depend on the grade of paper being produced or the papermaking machine speed. Although adjustment of the vertical orientation of the vibrational device 100, 200 as described above and shown in the drawings is through the use of a threaded rod and aperture connection, the vertical orientation of the vibrational device 100, 200 can be adjusted with any type of vertical adjustment mechanism or elevator as described above. Moreover, the vertical orientation of the vibrational device 100, 200 can be adjusted manually, if desired.

Once the vibrational device 100, 200 is installed and the vertical orientation with respect to the wire 16 is adjusted, the vibrational force generated by the plurality of vibration-inducing mechanisms 104, 204 is preferably modified depending on the type of paper being produced and the operating speed of the papermaking machine. The operating speed of the papermaking machine, i.e. the velocity of the web, is often from 100 feet per minute to 5000 feet per minute. The vibrational force is preferably adjusted until sufficient turbulence is created in the stock flow to create free suspension of the fibers and sufficient re-alignment of the fibers as described in greater detail above. The vibrational force is preferably varied by altering the input to the plurality of vibration-inducing mechanisms 104, 204. In some highly preferred embodiments, each one of the plurality of vibration-inducing mechanisms 104, 204 can be controlled independently in order (i.e., controlling vibration frequency and/or amplitude) to impart different forces to different portions of the cross-machine direction width of the wire 16. Imparting different forces to different portions of the wire 16 allows the amount of fiber re-alignment to be varied across the width of the wire 16. The control of the input to the vibration-inducing mechanisms 104, 204 is preferably integrated in a closed loop with a conventional digital control system for the papermaking machine.

Whether the vibrational force imparted to the wire 16 by the vibrational device 100, 200 is sufficient is determined by testing the web solids off of the couch roll 24 and press section and sheet samples from the reel section. Typical testing of the sheets includes visual inspection, internal bond, opacity, tear (tensile strength), and crush (compressive strength), smoothness, and any other standardized testing as stipulated by the Technical Association of the Pulp and Paper Institute (TAPPI). Applying a harmonic vibrational force to the web generally improves embryonic web formation and sheet properties with no deterioration of first pass retention, i.e., the fiber, fine, and filler content in the web is not lost. In addition, the phenomena of two-sidedness in the sheet is reduced, since the fiber distribution within the sheet is improved and boundary layer fibers are released from being impregnated in the wire 16.

Figure 10:
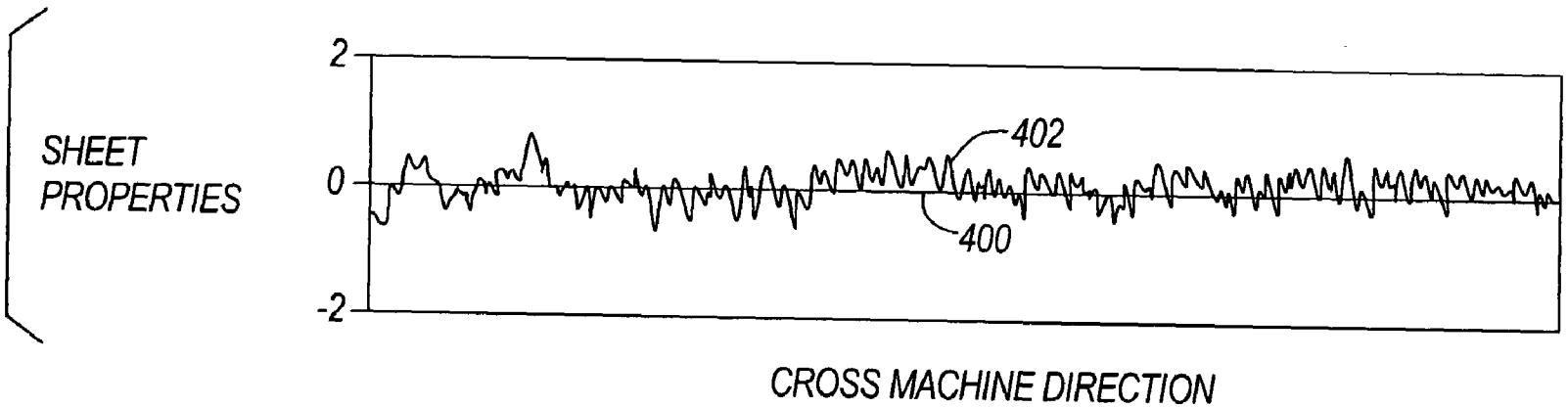
FIG. 10 is a graph of the sheet properties of a paper sheet in the cross-machine direction (width) of the paper sheet.

Sheet profiles, i.e. the characteristics of the sheet in the machine direction, the cross-machine direction, and the Z direction, are generally improved when a harmonic vibrational force is applied to the web as performed in the present invention. Sheet profile characteristics that are generally improved by applying a harmonic vibrational force to the web are strength, sheet weight, moisture content, and solid content. In particular, tensile strength in the machine direction is improved. Sheet properties are improved due to the more consistent re-aligning and re-settling of the fibers into empty voids. As shown in FIG. 10, sheet properties are often plotted versus the cross-machine direction (i.e., width) of the sheet. Ideally, the sheet properties would be constant across the width of the sheet as represented by line 400. However, the actual sheet properties generally vary across the width of the sheet as represented by plot 402. Applying a harmonic vibrational force to the web helps to make the sheet properties of the web more constant across the width of the sheet in order to approach line 400. Improvements in some sheet properties lead to faster machine speeds and less web breaks throughout the papermaking process, resulting in a substantial cost savings due to higher production rates.

The use of the vibrational device 100, 200 in the papermaking machine wet-end section 10 results in more water being drained from the web in a more efficient manner. As a result, some of the plurality of stationary foils 36 can be eliminated from the wet-end section 10. Moreover, since water drains more efficiently from the web, the energy required to dry the web in the dryer section of the papermaking machine is reduced. Since water removal is one of the most energy-intensive operations in the industrial papermaking process, a reduction in the energy necessary to dry the web results in a substantial reduction in operating costs.

It should be noted that a vibrational device 100, 200 can be installed beneath the papermaking machine frame 12 so that the vibrational device 100, 200 engages the wire 16 as the wire 16 returns to the headbox 14. In this configuration, the vibrational device 100, 200 positioned beneath the papermaking machine frame 12 acts as a wire-cleaning mechanism as the wire 16 is returned to the headbox 14.

Once the vibrational device 100, 200 has operated within the papermaking machine wet-end section 10 for an extended period of time, the vibrational element 150, 250 may become worn due to constant abrasion from engaging the wire 16. When the vibrational element 150, 250 becomes worn, the vibrational element 150, 250 can preferably be replaced either while the papermaking machine is operating or when the papermaking machine is not operating. Since the vibrational element 150, 250 is preferably coupled to the vibrational isolators 105, 205 and the vibrational head 106, 206 via a sliding mechanism 148, 248, the vibrational element 150, 250 can preferably be slid off of the sliding mechanism 148, 248 and removed from the vibrational head 106, 206. Similarly, a replacement vibrational element 150, 250 can be slid back onto the sliding mechanism 148, 248, even during operation of the papermaking machine.

Although the vibrational device 100, 200 of the present invention provides significant advantages in the papermaking process when used in the wet-end section 10 of a papermaking machine (as described above), the vibrational device 100, 200 can also be employed in the press section of a papermaking machine for improved operation thereof. It is important to note that above discussion regarding the structure and operation of the vibrational device 100, 200 in the wet-end section 10 of the papermaking machine (as shown and described with respect to FIGS. 1–10) applies equally when the vibrational device 100, 200 is employed in the press section of the papermaking machine.

Figure 11:
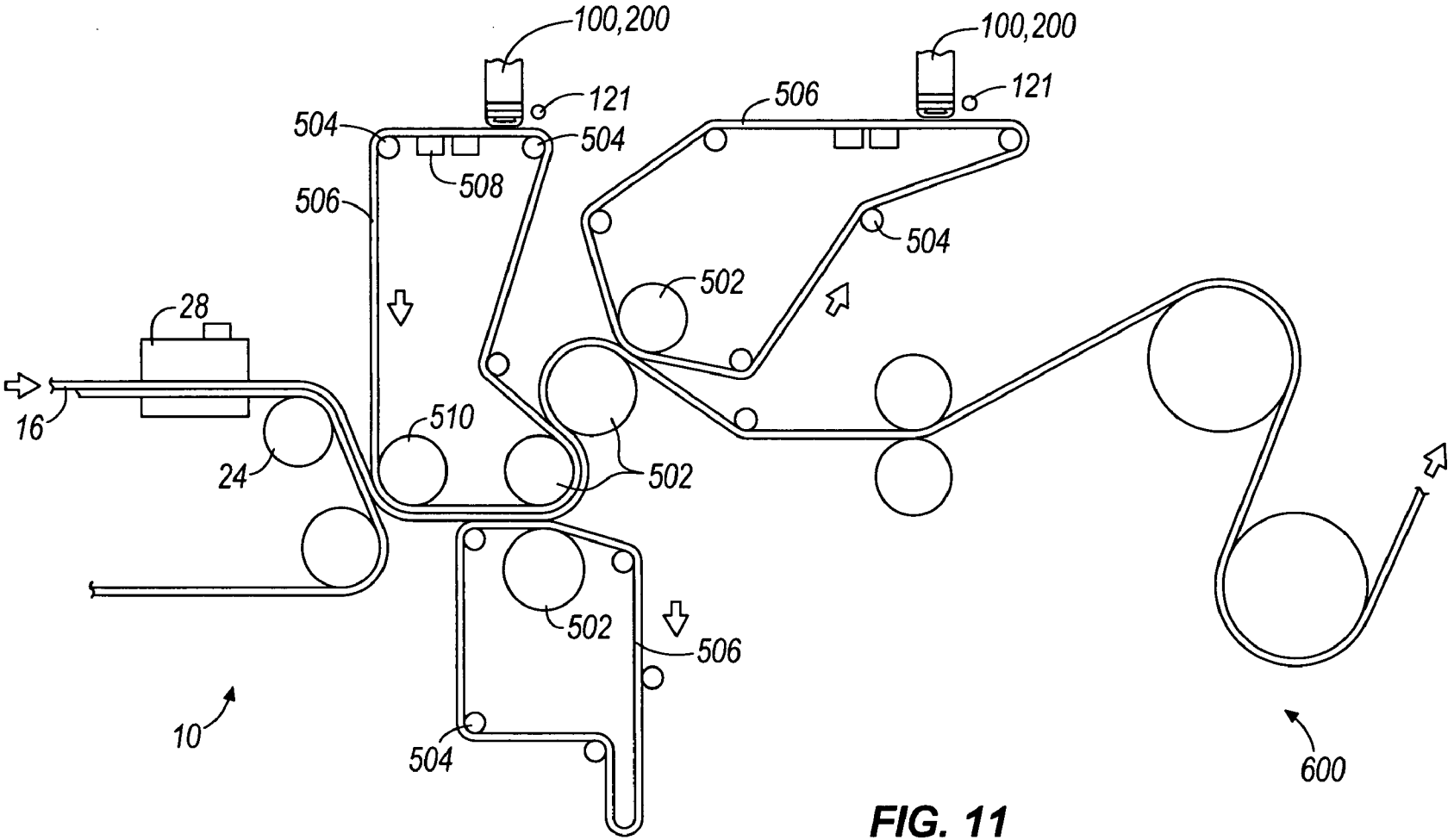
FIG. 11 is a schematic illustration of a papermaking machine having a wet-end section, a press section, and a dryer section.

As shown schematically in FIG. 11, a press section 500 follows the wet-end section 10 of a papermaking machine, and precedes a dryer section 600. The papermaking machine press-section 500 preferably includes press rolls 502, return rolls 504, press felts 506, and suction devices 508. The paper web is preferably transferred from the wet-end section 10 to the press-section 500 via a suction pick-up roll 510. The paper web travels between the press felts 506 and is carried through nips created by press rolls 502, which mechanically squeeze water from the paper web.

The press felt 506, which may also be referred to simply as the "felt," is preferably a moving, endless belt of cotton mesh fabric. Preferably, the press felt 506 is movably coupled to the papermaking machine frame 12 via several rolls in a manner that provides an endless conveyor belt for receiving and transporting the paper web delivered from the paper machine wet-end section 10. The press felt 506 first wraps around the pick-up roll 510, (which is preferably positioned adjacent to the couch roll 24), stretches from the pick-up roll 510 through the nip created by press rolls 502, wraps partially around the press rolls 502, and stretches around the return rolls 504 to return to the pick-up roll 510. One having ordinary skill in the art will appreciate that the press felt 506 can be driven about other elements in an endless-conveyor arrangement, such as by being passed around one or more sprockets, pulleys, or other preferably rotatable elements.

Figure 13:
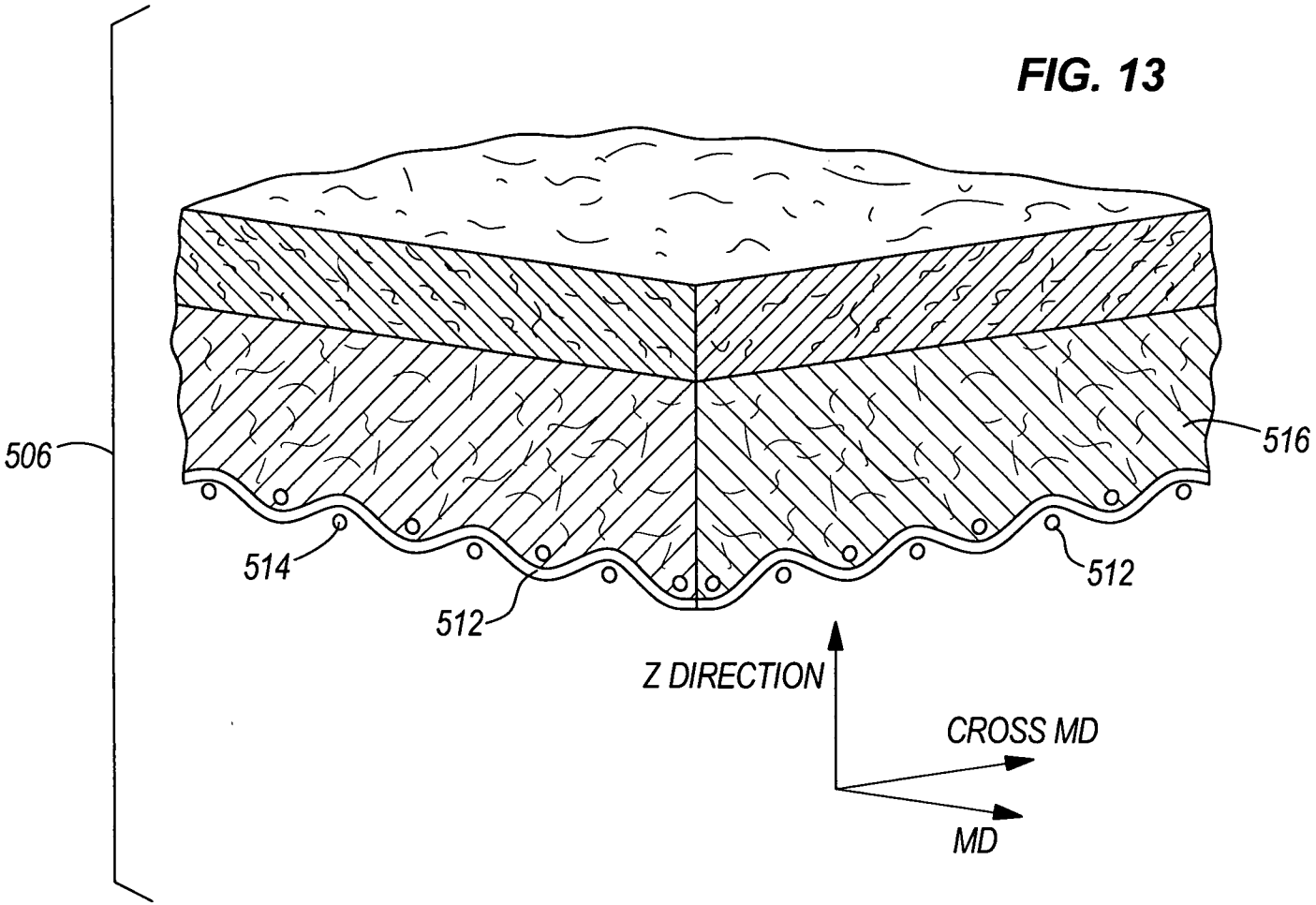
FIG. 13 is a schematic representation of a felt for use in the press section of a papermaking machine.

As shown in FIG. 13, the press felt 506 is preferably a multi-layered woven cotton or nylon-fiber mesh cloth that permits easy water absorption, yet provides sufficient strength and support so as not to mark or crush the paper web through the mechanical press. Although a woven cotton or nylon-fiber mesh cloth is preferred, any conventional felt material can be used as desired. As also shown in FIG. 13, in some embodiments a plurality of main strands 512 and a plurality of connecting strands 514 are woven together to form the base of the press felt 506. The plurality of main strands 512 and the plurality of connecting strands 514 can be made of finely drawn and woven, nylon, or can be made of other conventional materials, such as polyamide-based materials. A batt 516 is prepared in layers and needled onto the plurality of main strands 512 and the plurality of connecting strands 514. One of ordinary skill in the art will appreciate that the weave pattern of the press felt 506 can have a single, double, triple, or any other layer design. The press felt 506 is preferably not a permanent part of the press section 500 and can be replaced in a conventional manner.

Figure 12:
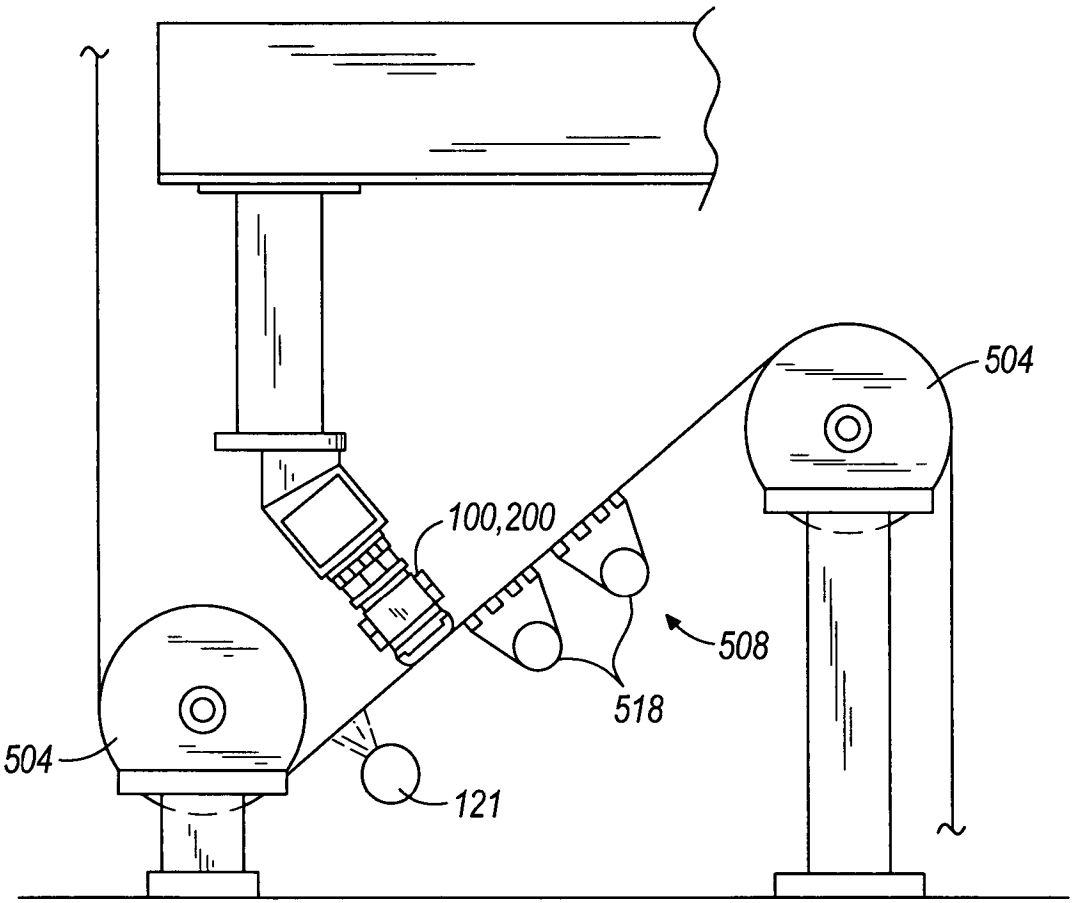
FIG. 12 is a side elevational view of a vibrational device according to an embodiment of the present invention, positioned within the press section of a papermaking machine.

As shown in FIGS. 11 and 12, suction devices 508 are preferably employed to remove as much water as possible from the press felts 506, leaving clean and porous press felts 506. In the preferred embodiment shown in FIG. 12, the suction devices 508 include uhle boxes 518. Uhle boxes 518 are elongated boards having a flat, top-side cover positioned on one side of the press felt 506. A vacuum source (not shown) is supplied to the uhle boxes 518 to generate a vacuum in order to pull water through the press felt 506. The vacuum created by the uhle boxes 518 preferably also pulls fines, fillers, and fibers that have become embedded from the press felt 506. A lubrication shower 121 can be positioned within the press section 500 upstream from the suction devices 508 in order to lubricate the underside of the press felt 506 to aid in removing fines, fillers, and fibers. If desired, alternative types of suction devices 508 can be used as desired to clean the press felt 506.

In the press section 500, the vibrational device 100 and the water delivered by the lubrication shower 121 help release boundary layer fibers, fines, and fillers that may have become impregnated in the press felt 506 due to the paper web being mechanically pressed into the press felt 506. Thus, the use of the vibrational device 100 in the press section 500 results in a cleaner press felt 506 and more efficient water removal from the paper web.

FIGS. 14*a*–16 illustrate a vibrational device 1000 which is an alternative embodiment of the vibrational devices 100 and 200 described above. Elements and features of the vibrational device 1000 illustrated in FIGS. 14*a*–16 having a form, structure, or function similar to that found in the vibrational devices 100 and 200 of FIGS. 1–8*e*, 11 and 12 are given corresponding reference numbers in the 1000 series. With the exception of mutually exclusive features and elements between the embodiment of FIGS. 1–8*e*, 11 and 12 and the embodiment of FIGS. 14*a*–16, reference is hereby made to the earlier embodiments for a more complete description of the features, elements (and alternatives thereto) of the embodiment illustrated in FIGS. 14*a*–16 and described below.

Figure 15:
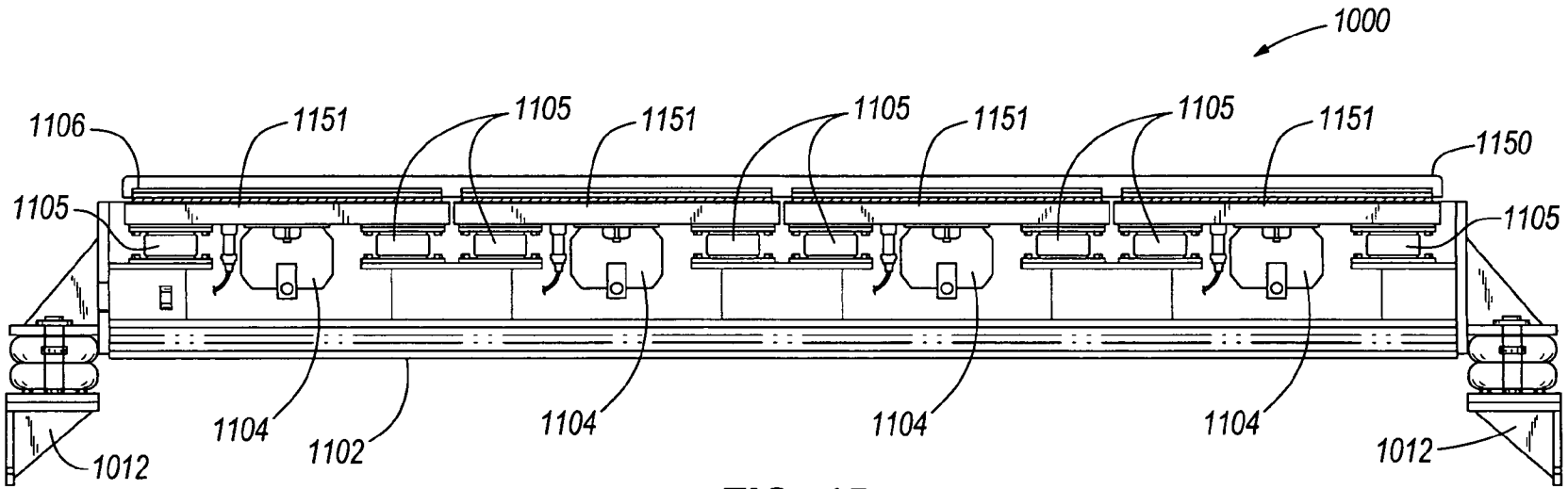
FIG. 15 is a front elevational view of a vibrational device having a single vibrational element mounted to multiple support members according to another embodiment of the present invention.

As shown in FIG. 15, the illustrated exemplary vibrational device 1000 includes a vibrational device frame 1102 mountable to the papermaking machine frame 1012 (or to other positions inside or adjacent the papermaking machine frame 1012), one or more vibration-inducing mechanisms 1104 coupled to the vibrational device frame 1102, a vibrational head 1106 coupled to the vibration-inducing mechanisms 1104, and one or more vibration isolators 1105 coupled between the vibrational head 1106 and the vibrational device frame 1102.

With reference again to the embodiment of the present invention illustrated in FIGS. 14*a*–16, the vibrational device 1000 can include more than one vibration-inducing mechanism 1104. For example, the vibrational device 1000 can include multiple vibration-inducing mechanisms 1104 positioned across the width (i.e., the cross-machine direction) of the wire (not shown). In some embodiments, the vibration-inducing mechanisms 1104 are coupled to the vibrational head 1106, but are not mounted to the vibrational device frame 1102. In the illustrated exemplary embodiment of FIGS. 14*a*–16, four vibration-inducing mechanisms 1104 are spaced across the width of the wire and are be coupled to the vibrational head 1106. As discussed in the earlier-described embodiments, any number of vibration-inducing mechanisms 1104 can be positioned in any manner (e.g., substantially equally spaced or in any other manner desired). Accordingly, other numbers and spacings of vibration-inducing mechanisms 1104 can be employed in order to span the cross-machine width of the wire.

In some embodiments, one or more of the vibration-inducing mechanisms 1104 are controlled individually so as to adjust the frequencies, phases and/or amplitudes of the vibrational forces transmitted from the vibration-inducing mechanisms 104 to different sections of the wire (i.e., different sections along the cross-machine direction of the wire). When the vibrational device 1000 includes more than one vibration-inducing mechanism 1104, it is often desirable to provide as much of a consistent vibrational output (in frequency, phase and amplitude) as possible along the entire cross-machine direction of the wire. In other words, it is desirable in some cases for web to have a substantially flat displacement profile in the cross-machine direction. However, when more than one vibrational force is provided to the vibrational head 1106 (e.g., by multiple vibration-inducing mechanisms 1104), the vibrational head 1106 can exhibit multiple modes of vibration. In other words, the vibrational head 1106 can exhibit alternating high and low amplitude sections, in some cases following a sinusoidal pattern of movement. This response from multiple vibrational forces can result if the vibrational head 1106 is not adequately rigid in comparison to its weight, although other variables contribute to such a response.

In some embodiments, the vibrational head 1106 includes one or more vibrational elements 1150 and one or more support members 1151. Several support members 1151 can be connected in order to accommodate the cross-machine width of the wire. In some embodiments, each support member 1151 is coupled to a different vibrational element 1150. If the support members 1151 and the corresponding vibrational elements 1150 are relatively short in length, the period of the vibrational response can be increased until the displacement profile of the vibrational device 1000 in the cross-machine direction is approximately flat. However, if each support member 1151 is coupled to one or more different vibrational elements 1150, the paper web may exhibit one or more streaks produced by the mismatched phase of adjacent support members 1151. To address this problem and/or other problems, a vibrational element 1150 can be mounted to adjacent support members 1151 (whether mounted to and spanning across the entire length of the adjacent support members 1151 or any fraction thereof) as will be described in greater detail below.

When the vibrational head 1106 includes multiple support members 1151, a feedback control system can be used to coordinate the frequencies provided to each support member 1151 by the vibration-inducing mechanisms 1104. In some embodiments, the feedback control system can control each support member 1151 independently by controlling the vibration-inducing mechanism(s) 1104 corresponding thereto. By way of example only, the frequency output of the vibration-inducing mechanisms 1104 in some embodiments can be controlled by the speed of pneumatic vibrator motors 1104 connected thereto.

The feedback control system (if employed) can utilize a master frequency set point for the vibration-inducing mechanisms 1104 and the corresponding support members 1151. For example, the feedback control system in some embodiments can control the vibration-inducing mechanisms 1104 (and the corresponding support members 1151) to within ±0.1 Hz of each other or within ±0.1 Hz of a master frequency set point. The feedback control system can include an accelerometer coupled to each support member 1151 in order to measure the frequency of each support member 1151. The accelerometer can send a signal to a programmable logic controller (PLC) or any other suitable controller or processor, which can respond to such signals by adjusting the speed of the vibration-inducing mechanisms (e.g., by adjusting pneumatic flow valves of pneumatic vibration-inducing mechanisms 1104) connected to any given support member 1151.

The feedback control system can control the frequency of all support members 1151 included in the vibrational head 1106, such as by separately controlling each vibration-inducing mechanism 104 and/or by separately controlling groups of vibration-inducing mechanisms (e.g., groups of two or more vibration-inducing mechanisms 104 on a support member 1151). However, regardless of the ability to control the speed at which each vibration-inducing mechanism 104 (or group of vibration-inducing mechanisms 104) operates, it can be difficult to control and coordinate the phases of adjacent support members 1151 of the vibrational head 1106. For example, each support member 1151 can be controlled to operate at the same frequency, but one support member 1151 can be moving upward while an adjacent support member 1151 is moving downward (i.e., adjacent support members 1151 may be operating 180° out-of-phase with respect to one another).

Even when a single vibrational element 1150 is employed, it can be difficult to precisely control and coordinate the phase and frequency of the vibrational force transmitted to the wire by two or more vibration-inducing mechanisms 1104. In order to coordinate the phase and the frequency of force generated by two or more of the vibration-inducing mechanisms 1104, the vibrational elements 1150 can be rigidly supported to the support members 1151 (whether sharing a common vibrational element 1150 or otherwise). For example, the vibrational elements 1150 can be rigidly supported the sliding mechanisms 1148 (described below) mounted to each support member 1151 in order to effectively transmit the vibrational force through the support members 1151 to the vibrational elements 1150. However, when one vibrational element 1150 is coupled to more than one vibration-inducing mechanism 1104, several problems may occur. First, the support members 1151 may vibrate out-of-phase until the speed of the vibration-inducing mechanisms 1104 cannot be adjusted by the feedback control system. This can occur when vibrational frequency from one support member 1151 is transmitted to an adjacent support member 1151 to an extent that "noise" from a first vibration-inducing mechanism 1104 on the first support member 1151 cannot be filtered from the detected movement of the adjacent support member 1151 (e.g., measured by an accelerometer coupled to the second support member 1151). Second, out-of-phase support members 1151 can cause the corresponding vibration-inducing mechanisms 1104 to lock and be unable to rotate or otherwise operate. Third, out-of-phase support members 1151 can produce extreme stresses on a shared vibrational element 1150 at a transition point between adjacent support members 1151. Extreme stresses can be imposed on the vibrational element 1150 when the phase of one support member 1151 tries to impose itself onto an adjacent support member 1151.

In some embodiments, phase control of two or more vibration-inducing mechanisms 104 can be achieved mechanically by drivably connecting the vibration-inducing mechanisms 104 together. By way of example only, some vibration-inducing mechanisms 104 employ an eccentrically-positioned mass rotatable with an axle of the vibration-inducing mechanism 104. The axles of two or more vibration-inducing mechanisms 104 can be drivably connected in any conventional manner (or a common axle can extend to and be shared by two or more vibration-inducing mechanisms 104) in order to simultaneously drive the eccentric masses of the mechanisms 104 in phase. In other embodiments however, no such common axle or coupled axles exist.

Figure 14A:
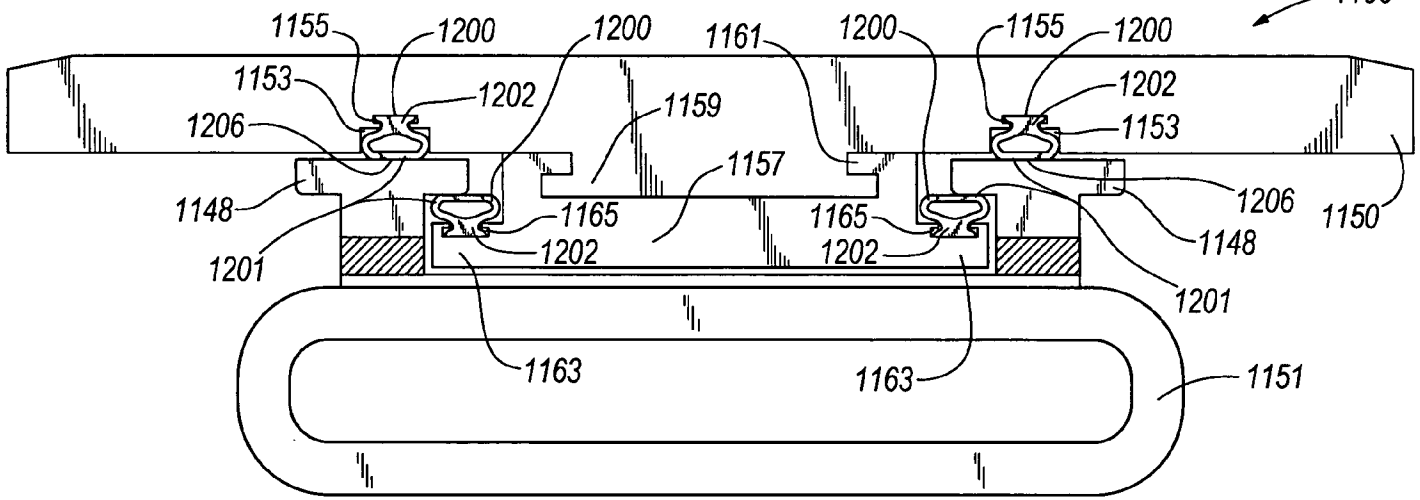
FIGS. 14*a* and 14*b* are cross-sectional views of a vibrational device having dampening mechanisms according to another embodiment of the present invention.
Figure 16:
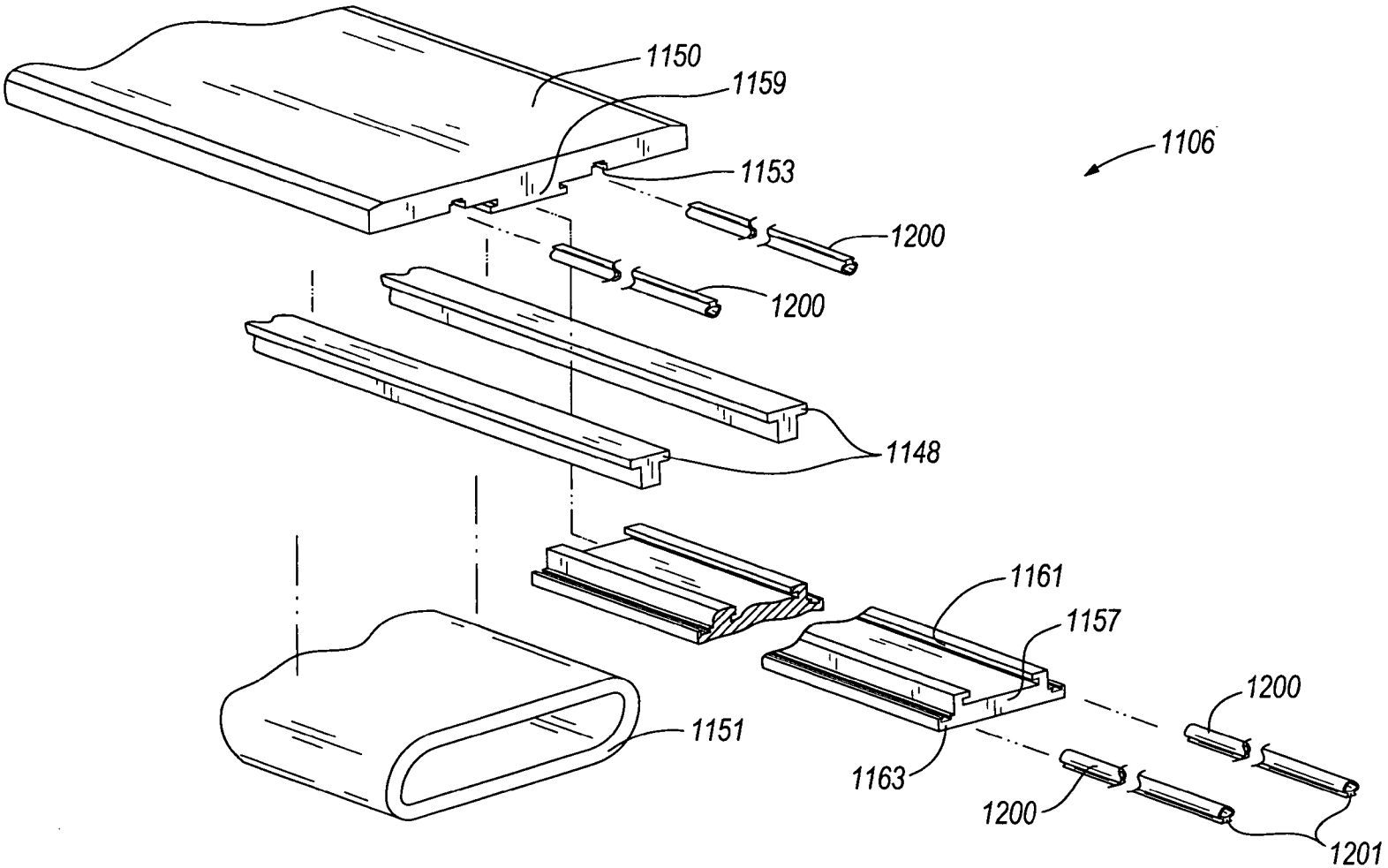
FIG. 16 is an exploded perspective view of the vibrational device of FIGS. 14*a* and 14*b*.

Another manner of support member phase control is illustrated by way of example in FIGS. 14*a*–16. With reference first to FIGS. 14*a*, 14*b* and 16, the vibrational head 1106 can include sliding mechanisms 1148 and a vibrational element 150 (e.g., a vibrational foil) coupled to the sliding mechanisms to mount the vibrational element 1150 to the support member 1151. The sliding mechanisms 1148 can be connected to the vibrational element 1150 in a number of different manners, such as by any of the sliding connections shown in FIGS. 7*a*–7*c* and 8*a*–8*e*. As shown in FIGS. 14*a*, 14*b* and 16, the vibrational head 1106 includes sliding mechanisms 1148 each having a T-shaped configuration. However, the sliding mechanisms 1148 can have any other configuration suitable for slidably coupling the vibrational element 1150 to the vibration-inducing mechanisms 1104. Any other slidable and non-slidable manner of connecting the vibrational element 1150 to the vibration-inducing mechanism (including without limitation any of those described above with reference to the embodiments illustrated in FIGS. 1–13) can instead be employed as desired. Sliding mechanisms 1148 (if employed) allow the vibrational element 1150 to be removed from the vibrational device 100, 200 and to be replaced—in some embodiments while the papermaking machine is operating.

With continued reference to the illustrated exemplary embodiment of FIGS. 14*a*–16, the vibrational device 1000 can include a single vibrational element 1150 mounted to more than one support member 1151. Any one or more of the support members 1151 can be coupled to one or more different vibration-inducing mechanisms 1104. Also, any number of vibrational elements 1150 can be mounted to two or more support members 1151. For example, as shown in FIG. 15, four support members 1151 and four vibration-inducing mechanisms 1104 are coupled to a single vibrational element 1150. In this regard, the single vibrational element 1150 can be coupled to more than one vibration-inducing mechanism 1104 (whether independently controlled or not). In some embodiments, each one of the vibration-inducing mechanisms 1104 is independently controlled, but each of the vibration-inducing mechanisms 1104 transfers a vibrational force having the same frequency to a common vibrational element 1150.

In order to align the phases of the vibrational forces transferred by multiple support members 1151 sharing a common vibrational element 1150 as described above, one or more dampening mechanisms 1200 can be positioned between, adjacent to, or in any suitable position with respect to the vibrational element 1150 and/or the sliding mechanisms 1148. The purpose of these dampening mechanisms 1200 (referred to herein also as "dampeners") is not to eliminate vibration passing to the vibrational element 1150

(the vibrational element 1150 still vibrates at a desired frequency and amplitude), but instead to dampen such vibration.

Figure 14B:
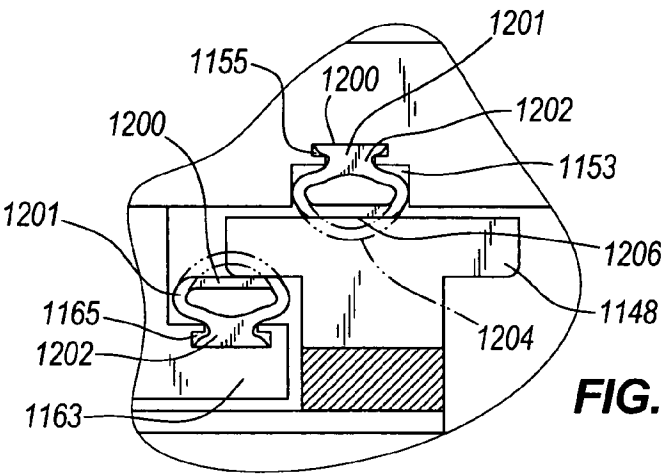

As shown in FIGS. 14*a*, 14*b* and 16 by way of example only, in some embodiments the bottom of the vibrational element 1150 includes one or more recesses 1153 within which the dampening mechanisms 1200 can be positioned (i.e., the dampening mechanisms 1200 can lie between the sliding mechanisms 1148 and the walls that form the recesses 1155 in the vibrational element 1150). In some embodiments, the dampening mechanisms 1200 can include male portions 1202 (e.g., T-shaped or dovetail male portions) that can be positioned within corresponding female portions 1155 in the recesses 1153 of the vibrational element 1150. Alternatively, the dampening mechanisms 1200 can merely lie between the vibrational element 1150 and the sliding mechanisms 1148 and/or can be secured to one or both of the vibrational element 1150 and the sliding mechanisms 1148 in any suitable manner (e.g., bolts, screws, buckles, clips, mating pins and apertures, rivets, threaded connections, snap-fit connections, press-fit connections, adhesives, resins such as epoxy or silicone, cohesive bonding material, and the like). In this regard, the dampening mechanisms 1200 need not necessarily be recessed within the vibrational element 1150. However, in other embodiments the dampening mechanisms 1200 are received at least partially within recesses in the vibrational element 1150 and/or the sliding mechanisms 1148. If recessed, the dampening mechanisms 1200 can be retained within the recess (es) in any of the manners described above.

In some embodiments, a secondary support member 1157 is positioned between the vibrational element 1150 and the support member 1151. The secondary support member 1157 can take the form of an elongated element to which the vibrational element 1150 is coupled, and can extend along the support members 1151. In some embodiments, the secondary support member 1157 extends at least partially across adjacent support members 1151, while in other embodiments the secondary support member 1157 extends only along a corresponding support member 1151 (in which case each support member 1151 can have a corresponding secondary support member 1157 employed to connect the vibrational element 1150 to the support member 1151).

As shown in FIGS. 14*a*, 14*b* and 16, the bottom surface of the vibrational element 1150 can include a male engagement surface 1159 (e.g., a T-shaped male engagement surface) that can be permanently or removably positioned within a corresponding female engagement surface 1161 in the secondary support member 1157. However, any number of releasable or non-releasable fasteners can be used to couple the vibrational element 1150 to the secondary support member 1157, such as T-shaped mating surfaces, dovetail mating surfaces, bolts, screws, buckles, clips, mating pins and apertures, nails, rivets, threaded connections, snap-fit connections, press-fit connections, and the like. Similarly, adhesives or resins (e.g., epoxy or silicone), cohesive bonding material, welds, and brazing can be used to couple the vibrational element 1150 to the secondary support member 1157. This connection can be made employing any of the other manners of connection described above with reference to the direct connection between the vibrational element 1150 and the support member 1151. Moreover, various embodiments can employ none, one, or some of the above-described fasteners and methods of attachment. Alternatively, the vibrational element 1150 and the secondary support member 1157 can be comprised of one integrally-connected member.

Dampening mechanisms 1200 can also be positioned between the sliding mechanisms 1148 and one or more portions of the secondary support member 1157. The secondary support member 1157 can include one or more flanges 1163. In some embodiments, the flanges 1163 include female portions 1165 that can receive the male portions 1202 of the dampening mechanisms 1200. In this manner, dampening mechanisms 1200 can, in some embodiments, lie between the flanges 1163 of the secondary support member 1157 and at least one portion of the bottom surfaces of the T-shaped sliding mechanisms 1148.

In some embodiments, each dampening mechanism 1200 is comprised of a fluid-filled tube or other flexible or deformable conduit 1201 that extends along the entire longitudinal length or at least part of the longitudinal length of the vibrational element 1150 (i.e., the length of the cross-machine direction of the wire). As shown in FIG. 14*b*, the dampening mechanisms 1200 can be filled with fluid until they reach an uncompressed position 1204 (indicated in phantom). When the dampening mechanisms 1200 are positioned with respect to the vibrational element 1150, the sliding mechanisms 1148, and the secondary support member 1157, the dampening mechanisms 1200 reach a compressed position 1206 and remain in that position during the operation of the papermaking machine. The fluid-filled dampening mechanisms 1200 therefore provide a dampening function for the vibrational element 1150.

In other embodiments, the dampening mechanism 1200 does not expand to an uncompressed position 124 as just described, but instead retains a shape that is increasingly resistant to flattening, compression, or other deformation with increased fluid pressure in the dampening mechanisms 1200. In still other embodiments, the dampening mechanism 1200 provides different stiffness properties based upon different internal fluid pressures regardless of the other properties of the dampening mechanisms 1200 at such pressures.

As described above, the dampening mechanism 1200 in the illustrated exemplary embodiment of FIGS. 14*a*–16 includes at least one conduit 1201 located between the vibrational element 1150 (or secondary support member 1157) and the support member 1151. It should be noted that the dampening mechanism 1200 can be defined by a single conduit 1201 passing between these elements in one or more lengths or runs of the conduit 1201 in the vibrational device 1000. Therefore, the four cross-sections of the dampening mechanism 1200 illustrated in FIG. 14*a* can be the same conduit 1201 or can be cross-sections of two, three, or four different conduits 1201 of the dampening mechanism 1200. Also, the fluid conduit(s) of the dampening mechanism 1200 can extend along substantially the entire length or any fraction of the length of a support member 1151 in the cross-machine direction, and can extend only along a single support member 1151 or can cross to one or more adjacent support members 1151. In this regard, a separate dampening mechanism 1200 can be provided for each support member 1151. Such an arrangement can provide separate control over the dampening properties of each support member 1151 in a vibrational device, and at least the ability to employ dampening mechanisms 1200 having different properties for different support members 1151. Alternatively, two or more support members 1151 can share the same dampening mechanism 1200 (e.g., the conduit(s) 1201 of a single dampening mechanism 1200 in some embodiments can extend along two or more support members 1151). Such an arrangement can still provide separate control over the dampening properties of groups of support members 1151 in a vibrational device, and at least the ability to employ dampening mechanisms 1200 having different properties for different groups of support members 1151.

In some embodiments, the fluid conduit(s) 1201 of the dampening mechanism 1200 can be filled with fluid under pressure. Fluid (such as air, a gas, a combination of gasses, or a liquid) can be supplied to the fluid conduit in any conventional manner, such as by a pump, a compressor, or a pressurized vessel coupled to the fluid conduits 1201, and the like. If desired, the pressure of fluid within the conduits 1201 can be selected to provide the conduit 1201 with a desired firmness, thereby providing a desired dampening for the vibrational element 1150. Also, in some embodiments the pressure of fluid within the conduits 1201 can be adjusted in any conventional manner, such as by operating a pump or compressor coupled thereto, operating one or more pressure relief or bleed valves coupled thereto, and the like. In still other embodiments, the dampening mechanism 1200 includes conduits 1201 that are neither pressurized nor connected to any device or element for this purpose. Instead, the conduits 1201 are comprised of material capable of dampening vibrations transmitted to the vibrational element 1150, such as rubber or plastic, urethane, nylon, neoprene, and the like.

Although the conduits 1201 of the exemplary dampening mechanism 1200 run along the length of the support members 1151 (whether in elongated runs of the same conduit 1201 running back and forth along the support members 1151 or otherwise), it should be noted that the conduits 1201 can run in a number of other directions or combination of directions in the dampening mechanism 1200 while still performing the same functions and still being located in the same positions as described above. Any path followed by the conduit(s) 1201 can be employed as desired, and falls within the spirit and scope of the present invention. Also, the vibrational device 1000 according to the present invention can have any number of conduits 1201 passing along any number of runs in the dampening mechanism 1200.

As described above, the dampening mechanism 1200 in the exemplary illustrated embodiment of FIGS. 14*a*–16 is positioned between the sliding mechanism 1148 and the vibrational element 1150 and secondary support member 1157. In other embodiments, the dampening mechanism 1200 can be located between only the sliding mechanism 1148 and the vibrational element 1150 or only between the sliding mechanism 1148 and the secondary support member. In general, the dampening mechanism 1200 is located between the vibrational element 1150 (or element mounted thereon) and the support member 1151 (or element mounted thereon). Accordingly, although the dampening mechanism 1200 could be located between the upper surface of the support member 1151 and an adjacent facing surface of the vibrational element 1150 by way of example only, the dampening mechanism 1200 in the illustrated exemplary embodiment is located as described above and illustrated in FIGS. 14*a*, 14*b*, and 16. In other embodiments, the vibrational device 1000 has no sliding mechanism 1158 and/or secondary support member 1157 (e.g., embodiments in which the vibrational element 1150 is connected to the rest of the vibrational device 1000 in other manners). In such cases, the dampening mechanism 1200 is not positioned adjacent a sliding mechanism 1148 and/or a secondary support member 1157, and is instead positioned in any other manner between the vibrational element 1150 and the support member 1151 suitable to dampen vibrations to the vibrational element 1150.

The dampening mechanisms 1200 in the exemplary embodiment of FIGS. 14*a*–16 are positioned between facing horizontal surfaces of the vibrational element 1150 (or secondary support member 1157) and the sliding mechanism 1148. However, it will be appreciated that the resulting damping functions can be achieved by dampening mechanisms 1200 positioned between other surfaces of the vibrational element 1150 or secondary support member 1157 and the sliding mechanism 1148. For example, the dampening mechanisms 1200 can be positioned between vertical surfaces, diagonal surfaces (with reference to the view of FIGS. 14*a* and 14*b*), irregular surfaces, or surfaces having any other orientation. Dampening mechanisms 1200 can therefore be employed to dampen vibrations exerted in a vertical direction, in a horizontal direction, in a diagonal direction, or in any combination of directions based upon the position of the dampening mechanisms 1200 between the vibrational element 1150 (or element mounted thereon) and the sliding mechanism 1148.

As shown in FIGS. 14*a*, 14*b* and 16, the dampening mechanism 1200 in the illustrated exemplary embodiment generally serves to dampen vibration between the sliding mechanism 1148 and the vibrational element 1150 and/or secondary support member 1157. As described above, in some embodiments pressure within the conduit(s) 1201 of the dampening mechanism 1200 can be adjusted. For example, the stiffness of the conduit(s) 1201 can be adjusted so that the stiffness is sufficient to transmit vibrational force through to the vibrational element 1150, yet flexible enough to substantially eliminate or at least reduce the differences in phase that can occur between adjacent support members 1151 along the cross-machine direction of the wire. In some embodiments, the conduit(s) 1201 of the dampening mechanisms 1200 can be adjusted until the phase of the vibrational force exerted on a shared vibrational element 1150 is substantially equal along adjacent vibrational elements, and along the entire cross-machine direction of the wire, if desired. Also, in some embodiments the conduit(s) 1201 of the dampening mechanisms 1200 can also be adjusted so that the vibrational force from one vibration-inducing mechanism 1104 reinforces the vibrational force from an adjacent vibration-inducing mechanism 1104 through a shared vibrational element 1150, thereby reducing the power required to operate the vibration-inducing mechanisms 1104.

Although conduits (pressurized or not, and having controllable pressure or not) are employed in the illustrated exemplary embodiment of FIGS. 14*a*–16, other dampening devices and elements can instead be employed to perform the same functions just described (i.e., to reduce or substantially eliminate phase differences between adjacent support members 1151 while still permitting vibration to be transmitted to the vibrational elements 1150). For example, the dampening mechanisms 1200 can comprise strips, bars, pads, or other elements of resilient deformable or other dampening material (e.g., rubber, plastic, urethane, nylon, neoprene, and the like), liquid-filled conduits, electromagnets or magnetic rails, viscoelastic material, constrained-layer dampening structures, and the like. The dampening mechanisms 1200 can extend along any part or all of the cross-machine direction of the wire.

In some embodiments, the width of the vibrational element 1150 is increased in order to increase the amplitude of vibration. As shown in FIG. 14*a* for example, the width of the vibrational element 1150 can extend beyond the width of the support member 1151. During operation, movement of the vibrational element 1150 can be substantially vertical, or can be rotational (in the view of FIGS. 14*a* and 14*b*), whereby the vibrational element 1150 and the support members 1150 move in a round, elliptical, oval, or other rotund path as the support members 1151 and vibrational element 1150 moves vertically upward and downward. Such motion can be enabled at least in part by the vibration isolators (not visible in FIGS. 14*a*–16) to which the support members 1151 are coupled. By increasing the width of the vibrational element 1150, more energy (i.e., a vibrational force having a greater amplitude) can be transmitted to the wire in some embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

We claim:

1. A vibrational device for use with a papermaking machine having a wire, the vibrational device comprising:

at least one vibration-inducing mechanism;

a vibrational head coupled to the at least one vibration-inducing mechanism and movable to impart a vibrational force to the wire, the vibrational head having a support and a vibrational element coupled to the support and positionable adjacent the wire, the vibrational element having a surface substantially facing the wire and across which the wire passes during operation of the papermaking machine; and at least one dampener coupled between the vibration-inducing mechanism and the vibrational element.

2. The vibrational device of claim 1, wherein the at least one dampener comprises a conduit containing fluid.

3. The vibrational device of claim 2, wherein fluid pressure in the conduit is adjustable.

4. The vibrational device of claim 1, wherein the at least one dampener is located between the vibrational element and the support of the vibrational head.

5. The vibrational device of claim 4, wherein the at least one dampener comprises a conduit containing fluid.

6. The vibrational device of claim 1, wherein the at least one dampener comprises elastomeric material.

7. The vibrational device of claim 1, wherein the vibrational element is slidably coupled to the support.

8. The vibrational device of claim 7, wherein the support includes at least one T-shaped member by which the vibrational element is coupled to the support.

9. The vibrational device of claim 1, wherein the vibrational element is coupled to first and second supports positioned end-to-end in a cross-machine direction of the papermaking machine, each support coupled to and vibrated by a respective vibration-inducing mechanism.

10. The vibrational device of claim 9, wherein a machine-direction width of the vibrational element is greater than a machine-direction width of each one of the first and second supports.

11. The vibrational device of claim 9, wherein the at least one dampener extends in the cross-machine direction along at least part of each of the first and second supports.

12. The vibrational device of claim 9, wherein:

the first and second support members have a first combined length in a cross-machine direction of the wire; and the at least one dampener extends along at least a majority of the first combined length of the first and second support members.

13. The vibrational device of claim 9, wherein at least one of the vibration-inducing mechanisms is controllable independently of another of the vibration-inducing mechanisms to adjust vibrational forces between different supports.

14. The vibrational device of claim 1, further comprising a feedback control system adapted to adjust the frequency of the at least one vibration-inducing mechanism.

15. The vibrational device of claim 14, wherein:

the vibrational head includes at least two supports positioned end-to-end in a cross-machine direction; and the feedback control system includes a controller and at least two accelerometers each coupled to a respective support of the at least two supports.

16. The vibrational device of claim 1, wherein the at least one vibration-inducing mechanism is pneumatically powered.

17. The vibrational device of claim 1, wherein:

the vibrational head further includes a secondary support; and the at least one dampener is coupled between the support and the secondary support.

18. The vibrational device of claim 17, wherein the support has at least one connector positioned for coupling the vibrational element to the support.

19. The vibrational device of claim 18, wherein the at least one connector establishes a sliding connection between the vibrational element and the support.

20. The vibrational device of claim 17, wherein at least one of the vibrational element and the secondary support includes a recess into which the at least one dampener is received.

21. The vibrational device of claim 20, wherein the at least one dampener is secured within the recess.

22. A vibrational device for use with a papermaking machine having a wire, the vibrational device comprising:

first and second vibration-inducing mechanisms; and a vibrational head including a vibrational element and first and second supports, the first and second supports coupled to and driven by the first and second vibration-inducing mechanisms, respectively, the vibrational element coupled to and driven by the first and second vibration-inducing mechanisms via the first and second supports to transmit vibrational force to the wire, the first vibration-inducing mechanism controllable independently of the second vibration-inducing mechanism.

23. The vibrational device of claim 22, further comprising at least one dampener coupled adjacent at least one of the vibrational element and the first and second supports.

24. The vibrational device of claim 23, wherein the at least one dampener is a conduit containing fluid.

25. The vibrational device of claim 24, wherein fluid pressure in the conduit is adjustable.

26. The vibrational device of claim 22, wherein the vibrational element spans across a seam between the first and second supports.

27. The vibrational device of claim 26, wherein the vibrational element spans across at least a majority of each of the first and second supports.

28. The vibrational device of claim 23, wherein the at least one dampener comprises elastomeric material.

29. The vibrational device of claim 1, wherein the vibrational element is slidably coupled to the first and second supports.

30. The vibrational device of claim 29, wherein each of the first and second supports includes at least one T-shaped member by which the vibrational element is coupled to the first and second supports.

31. The vibrational device of claim 23, wherein:

the first and second supports extend a first combined length in the cross-machine direction; and the at least one dampener extends at least a second length in the cross machine direction, the second length being substantially the same length as the first combined length.

32. The vibrational device of claim 22, further comprising a feedback control system adapted to adjust the frequency of the first and second vibration-inducing mechanisms.

33. The vibrational device of claim 32, wherein:

the first and second supports are positioned end-to-end in a cross-machine direction; and the feedback control system includes a controller and at least two accelerometers coupled to the first and second supports.

34. The vibrational device of claim 22, wherein the at least one vibration-inducing mechanism is pneumatically powered.

35. The vibrational device of claim 22, wherein at least one dampener is coupled between the vibrational element and connectors of the first and second supports.

36. The vibrational device of claim 22, further comprising a secondary support coupled to the vibrational head, wherein at least one dampener is coupled between the support and the secondary support.

37. The vibrational device of claim 36, wherein at least one of the vibrational element and the secondary support includes a female recess into which the at least one dampener is received.

38. The vibrational device of claim 37, wherein the at least one dampener is secured within the recess.

39. The vibrational device of claim 22, wherein a machine-direction width of the vibrational element is greater than a machine-direction width of each one of the first and second supports.

* * * * *